US006198449B1

(12) United States Patent
Muhlhauser et al.

(10) Patent No.: US 6,198,449 B1
(45) **Date of Patent: *Mar. 6, 2001**

(54) MULTIPLE BEAM ANTENNA SYSTEM FOR SIMULTANEOUSLY RECEIVING MULTIPLE SATELLITE SIGNALS

(75) Inventors: Nicholas L. Muhlhauser; Thomas C. Weakley, both of Los Gatos, GA (US); Scott A. Townley, Gilbert, AZ (US)

(73) Assignee: **E*Star, Inc.**, Los Gatos, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/172,669

(22) Filed: Oct. 15, 1998

Related U.S. Application Data

(63) Continuation-in-part of application No. 08/519,282, filed on Aug. 25, 1995, now Pat. No. 5,831,582, which is a continuation-in-part of application No. 08/299,376, filed on Sep. 1, 1994, now Pat. No. 5,495,258.

(51) Int. Cl.[7] ..... H01Q 19/06

(52) U.S. Cl. ..... 343/753; 343/895; 343/853

(58) Field of Search ..... 343/753, 895, 343/853, 789, 754, 844, 850; 342/361, 362, 375, 371, 372; H01Q 19/06

(56) References Cited

U.S. PATENT DOCUMENTS

| | | | |
|---|---|---|---|
| 2,682,610 | 6/1954 | King . | |
| 2,735,092 | 2/1956 | Brown Jr. . | |
| 2,816,271 | 12/1957 | Barker . | |
| 2,847,672 | 8/1958 | Giffen et al. | 343/895 |
| 2,863,148 | 12/1958 | Gammon et al. . | |
| 2,934,762 | 4/1960 | Smedes . | |
| 2,953,781 | 9/1960 | Donnellan et al. . | |
| 2,977,594 | 3/1961 | Marston et al. . | |
| 2,982,959 | 5/1961 | Hanneken . | |
| 3,017,633 | 1/1962 | Marston et al. . | |
| 3,135,960 | 6/1964 | Kaiser et al. . | |
| 3,170,158 | 2/1965 | Rotman . | |
| 3,267,472 | 8/1966 | Fink . | |
| 3,369,197 | 2/1968 | Giger et al. . | |
| 3,509,572 | 4/1970 | Barbano . | |
| 3,623,118 | 11/1971 | Monser et al. . | |
| 3,718,932 | 2/1973 | Ikrath et al. . | |
| 3,795,005 | 2/1974 | Monser et al. . | |

(List continued on next page.)

FOREIGN PATENT DOCUMENTS

| | | |
|---|---|---|
| 0682383 | 11/1995 | (EP) . |
| 0553707 | 5/1996 | (EP) . |
| 56-141602 | 11/1981 | (JP) . |
| 58-187003 | 11/1983 | (JP) . |

OTHER PUBLICATIONS

"Broadband Quasi–Taper Helical Antennas" By J.L. Wong and H.E. King 1979.

(List continued on next page.)

*Primary Examiner*—Hoanganh Le
(74) *Attorney, Agent, or Firm*—Liniak, Berenato, Longacre & White

(57) ABSTRACT

A multiple beam array antenna system including a first group of right-handed circularly polarized subarrays and a second group of left-handed circularly polarized subarrays. Combined signals from the right-handed subarrays are output via low noise amplifiers to a first electromagnetic lens while the outputs of the left-handed circularly polarized subarrays are sent via low noise amplifiers to a second steering electromagnetic lens. A satellite selection matrix output block allows a user to tap into signals from right-handed circularly polarized satellites, left-handed circularly polarized satellites, and linearly polarized satellites. A plurality of satellites (e.g. right-handed satellite "A" and linearly polarized satellite "B") may be accessed simultaneously thus allowing the user to utilize both signals at the same time.

4 Claims, 15 Drawing Sheets

U.S. PATENT DOCUMENTS

| | | | | |
|---|---|---|---|---|
| 3,864,688 | | 2/1975 | Hansen et al. . | |
| 3,931,624 | | 1/1976 | Hundley et al. . | |
| 4,123,759 | | 10/1978 | Hines et al. . | |
| 4,315,266 | | 2/1982 | Ellis, Jr. . | |
| 4,400,703 | | 8/1983 | Shiokawa et al. . | |
| 4,427,984 | | 1/1984 | Anderson . | |
| 4,467,294 | | 8/1984 | Janky et al. . | |
| 4,494,117 | | 1/1985 | Coleman . | |
| 4,584,588 | | 4/1986 | Möhring et al. . | |
| 4,647,938 | | 3/1987 | Roederer et al. . | |
| 4,680,591 | | 7/1987 | Axford et al. . | |
| 4,785,302 | | 11/1988 | Ma et al. . | |
| 4,791,428 | | 12/1988 | Anderson . | |
| 4,845,507 | | 7/1989 | Archer et al. . | |
| 4,920,351 | | 4/1990 | Bartlett et al. . | |
| 5,041,842 | | 8/1991 | Blaese . | |
| 5,053,786 | | 10/1991 | Silverman et al. . | |
| 5,061,943 | | 10/1991 | Rammos . | |
| 5,117,240 | | 5/1992 | Anderson . | |
| 5,146,234 | | 9/1992 | Lalezari . | |
| 5,227,807 | | 7/1993 | Bohlman et al. . | |
| 5,243,358 | | 9/1993 | Sanford el al. . | |
| 5,255,004 | | 10/1993 | Berkowitz et al. . | |
| 5,258,771 | | 11/1993 | Praba . | |
| 5,345,248 | | 9/1994 | Hwang et al. . | |
| 5,359,336 | | 10/1994 | Yoshida . | |
| 5,495,258 | * | 2/1996 | Muhlhauser et al. | 343/753 |
| 5,619,173 | | 4/1997 | King et al. . | |
| 5,652,597 | | 7/1997 | Caille . | |
| 5,686,923 | | 11/1997 | Schaller . | |
| 5,831,582 | * | 11/1998 | Muhlhauser et al. | 343/753 |

OTHER PUBLICATIONS

"Grating Lobe Control in Limited Scan Arrays" by Mailloux, et. al., 1979.
"Short Helical Antenna Array Fed From A Waveguide" by Nakano, et. al., 1984.
"Radiation From A Sheath Helix Excited by a Circular Waveguide: A Wiener–Hopf Analysis" by Fernandes, et. al., 1990.
"Low–Profile Helical Array Antenna Fed From A Radial Waveguide" by Nakano, et. al., 1992.
"Wave Propagation On Helical Antennas" by Cha, 1972.
"Review of Radio Frequency Beamfoaming Techniques for Scanned And Multiple Beam Antennas" by Hall, 1990.
"Design Trades for Rotman Lenses" by Hansen, 1991.
"Design of Compact Low–Loss Rotman Lenses" by Rogers, 1987.
"Focusing Characteristics of Symmetrically Configured Bootlace Lenses" by Shelton, 1978.
"A Microsoft Multiple Beam Forming Lens" by Fong, et. al., 1983.
"Design Considerations for Ruze and Rotman Lenses" by Smith, 1982.
"Amplitude Performance of Ruze and Rotman Lenses" by Smith, et. al., 1983.
"Microsoft Port Design and Sidewall Absorption for Printed Rotman Lenses" by Musa, et. al., 1989.
"Wide–Angle Microwave Lens for Line Source Applications" by Rotman, et. al., 1962.
"Short Helical Antenna Array Fed From A Waveguide" by Nakano, et. al., 1983.
"A Study of the Sheath Helix with a Conducting Core and its Application to the Helical Antenna" by Neureuther, 1967.
"Wave Propagation on Helices" by Mittra, 1963.
"Array of Helices Coupled a Waveguide" by Nakano, et. al.
"Array Antenna Composed of 4 Short Axial–Mode Helical Antenna" by Shiokawa.
PCT, WO 94/16472, Jul. 1974.
PCT, WO 92/07394, Apr. 1992.

* cited by examiner

FIG.9D
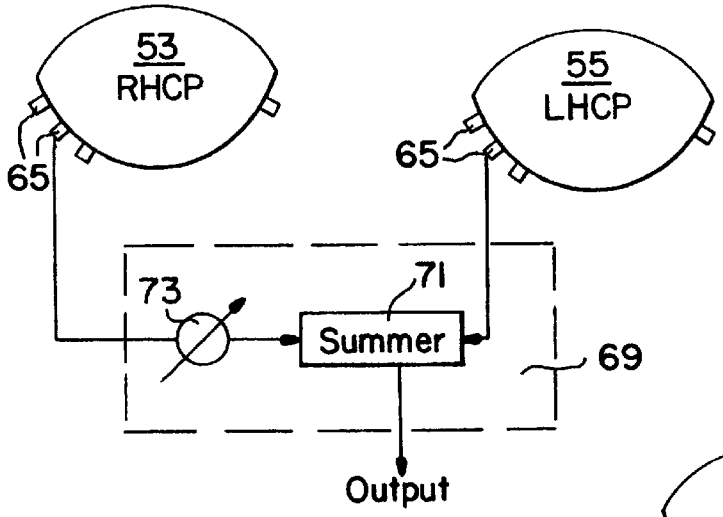
FIG.9F
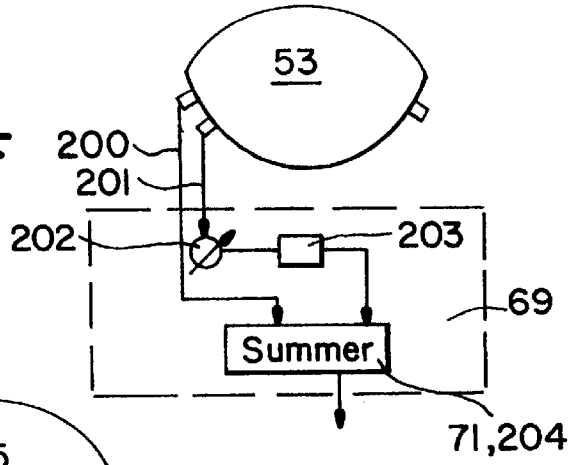
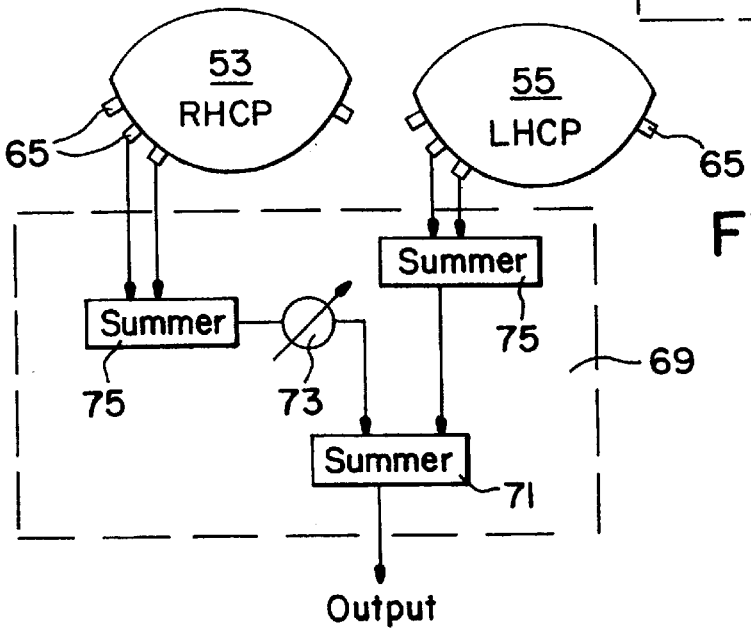
FIG.9E 1
13
15
25
31
116
119

MULTIPLE BEAM ANTENNA SYSTEM FOR SIMULTANEOUSLY RECEIVING MULTIPLE SATELLITE SIGNALS

This application is a continuation-in-part of application Ser. No. 08/519,282; filed Aug. 25, 1995 now U.S. Pat. No. 5,831,582, which is a continuation-in-part of application Ser. No. 08/299,376; filed Sep. 1, 1994 now U.S. Pat. No. 5,495,258.

This invention relates to an array antenna system. More particularly, this invention relates to a multiple beam array antenna system of relatively high directivity helical elements including a plurality of electromagnetic lenses and multiple antenna element subarrays, each subarray being of either the right or left handed circularly polarized type.

BACKGROUND OF THE INVENTION

High gain antennas are widely useful for communication purposes such as radar, television receive-only (TVRO) earth station terminals, and other conventional sensing/transmitting uses. In general, high antenna gain is associated with high directivity, which in turn arises from a large radiating aperture.

U.S. Pat. No. 4,845,507 discloses a modular radio frequency array antenna system including an array antenna and a pair of steering electromagnetic lenses. The antenna system of this patent utilizes a large array of antenna elements (of a single polarity) implemented as a plurality of subarrays driven with a plurality of lenses so as to maintain the overall size of the system small while increasing the overall gain of the system. Unfortunately, the array antenna system of this patent cannot simultaneously receive both right-hand and left-handed circularly polarized signals, and furthermore cannot simultaneously receive signals from different satellites wherein the signals are right-handed circularly polarized, left-handed circularly polarized, linearly polarized, or any combination thereof.

U.S. Pat. No. 5,061,943 discloses a planar array antenna assembly for reception of linear signals. Unfortunately, the array of this patent, while being able to receive signals in the fixed satellite service (FSS) and the broadcast satellite service (BSS) at 10.75 to 11.7 GHz and 12.5 to 12.75 GHz, respectively, cannot receive signals (without significant power loss and loss of polarization isolation) in the direct broadcast (DBS) band, as the DBS band is circular (as opposed to linear) in polarization.

U.S. Pat. No. 4,680,591 discloses an array antenna including an array of helices adapted to receive signals of a single circular polarization (i.e. either right-handed or left-handed). Unfortunately, because satellites transmit in both right and left-handed circular polarizations to facilitate isolation between channels and provide efficient bandwidth utilization, the array antenna system of this patent is blind to one of the right-handed or left-handed polarizations because all elements of the array are wound in a uniform manner (i.e. the same direction).

It is apparent from the above that there exists a need in the art for a multiple beam array antenna system (e.g. of the TVRO type) which is small in size, cost effective, and modular so as to increase gain without significantly increasing cost. There also exists a need for such a multiple beam array antenna system having the ability to receive each of right-handed circularly polarized signals, left-handed circularly polarized signals, and linearly polarized signals. Additionally, the need exists for such an antenna system having the potential to simultaneously receive signals from different satellites, the different signals received being of the right-handed circularly polarized type, left-handed circularly polarized type, linearly polarized typed, or combinations thereof. It is the purpose of this invention to fulfill the above-described needs in the art, as well as other needs apparent to the skilled artisan from the following detailed description of this invention.

Those skilled in the art will appreciate the fact that array antennas are reciprocal transducers which exhibit similar properties in both transmission and reception modes. For example, the antenna patterns for both transmission and reception are identical and exhibit approximately the same gain. For convenience of explanation, descriptions are often made in terms of either transmission or reception of signals, with the other operation being understood. Thus, it is to be understood that the array antennas of the different embodiments of this invention to be described below may pertain to either a transmission or reception mode of operation. Those skilled in the art will also appreciate the fact that the frequencies received/transmitted may be varied up or down in accordance with the intended application of the system. Those of skill in the art will further realize that right and left-handed circular polarization may be achieved via properly summing horizontal and vertical linearly polarized elements. It is also noted that the array antenna to be described below may simultaneously receive and transmit different signals.

SUMMARY OF THE INVENTION

Generally speaking, this invention fulfills the above-described needs in the art by providing a multiple beam array antenna system for simultaneously receiving/transmitting signals of different polarity, the system comprising:

means for receiving/transmitting both linearly and circularly polarized signals at substantially the same frequencies; and means for simultaneously receiving/transmitting at least two of: (i) right-handed circularly polarized signals; (ii) left-handed circularly polarized signals; and (iii) linearly polarized signals.

This invention will now be described with respect to certain embodiments thereof, accompanied by certain illustrations, wherein:

IN THE DRAWINGS

Figure 9A:
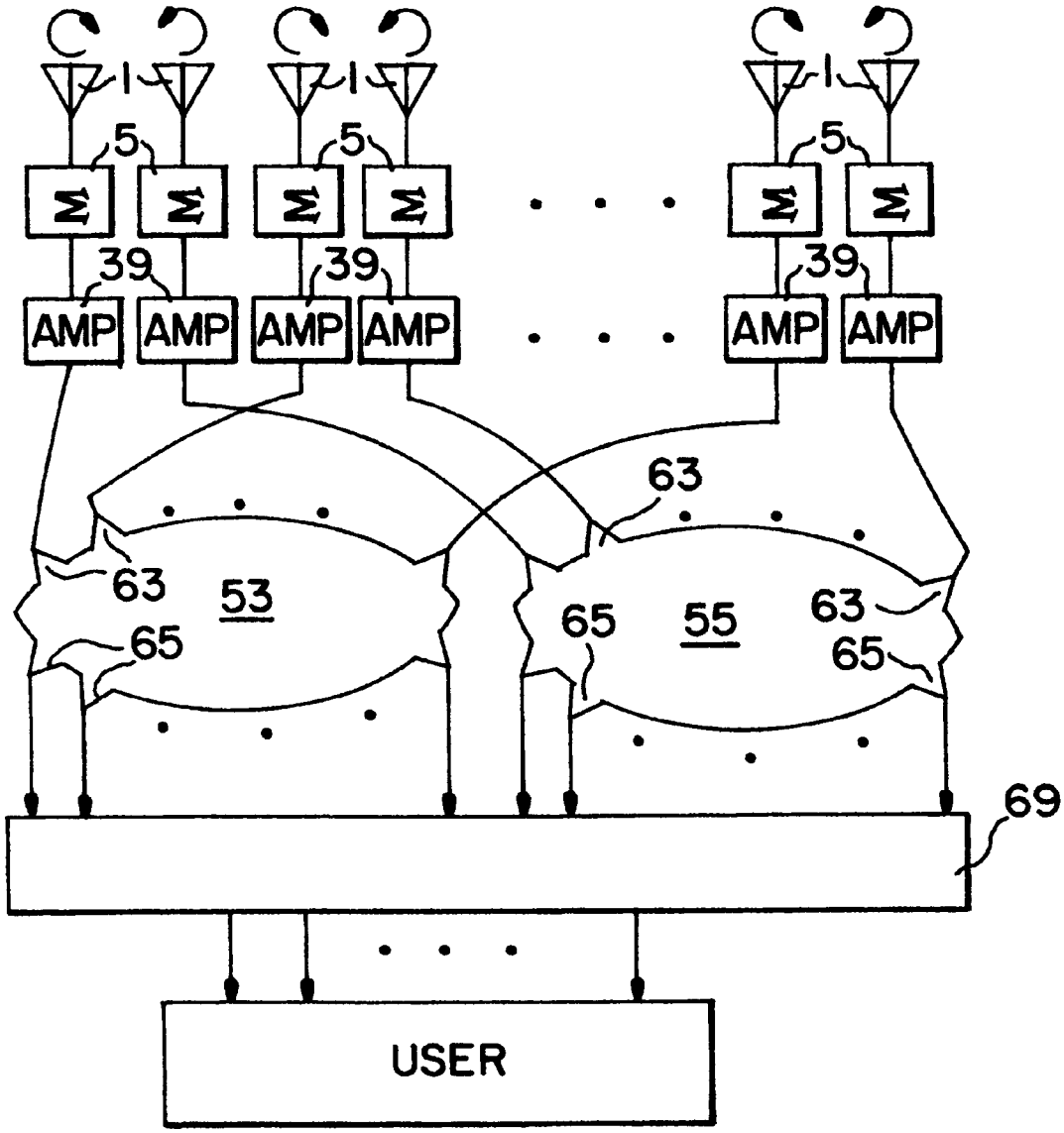
FIG. 9(*a*) is a schematic diagram of the FIG. 1 (of FIG. 2) embodiment of this invention illustrating the different subarrays, combining waveguides, low noise amplifiers, electromagnetic lenses, and satellite selection output matrix block.
Figure 9B:
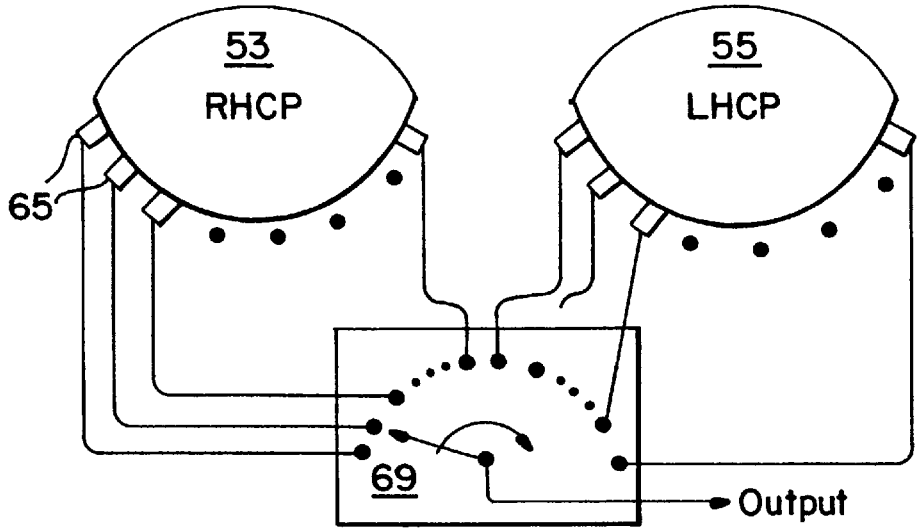
Figure 9C:
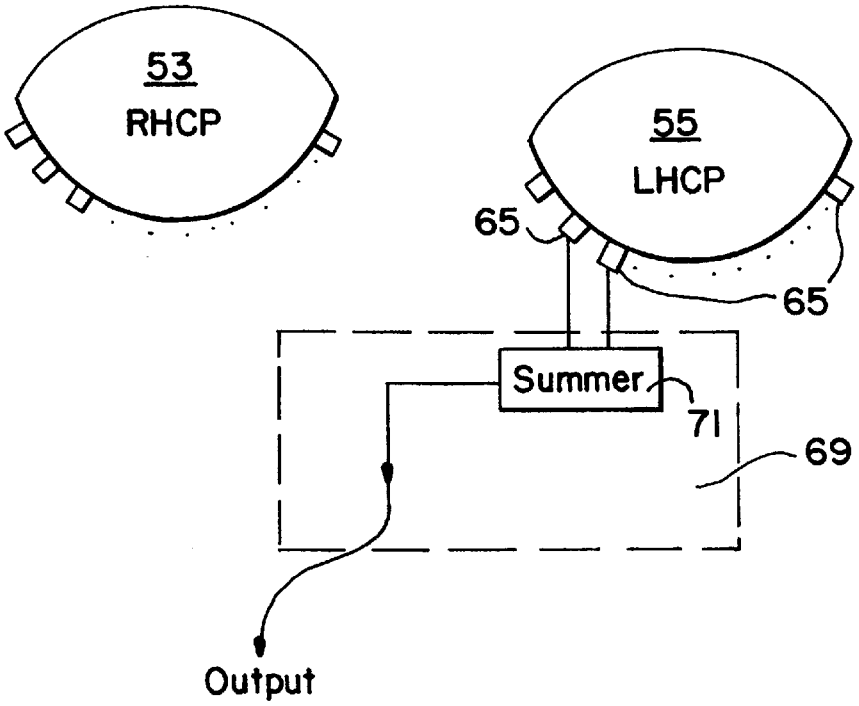

FIGS. 9(*b*)–9(*f*) are schematic diagrams illustrating different scenarios of the electromagnetic lenses being manipulated by the output block in order to view particular satellite (s).

Figure 10:
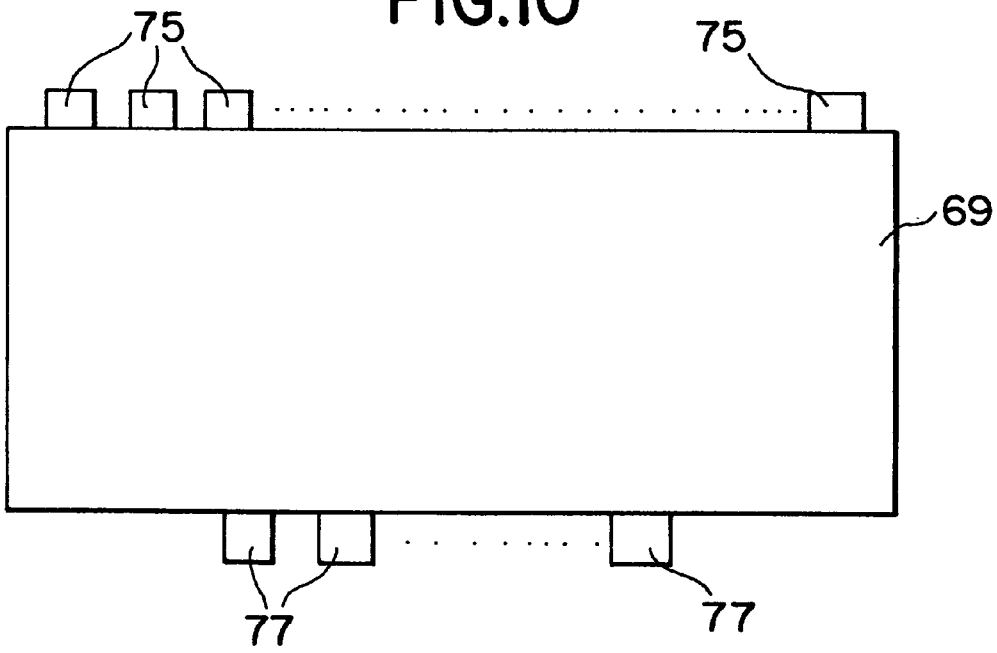

FIG. 10 is a side elevational view of the output matrix block according to the first or second embodiment of this invention.

Figure 11:
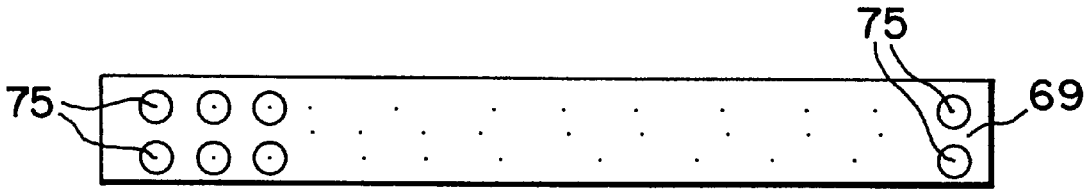

FIG. 11 is a front elevational view of the output block of FIG. 10, this view illustrating the output block inputs enabling electrical connection via transmission lines between the output block and the electromagnetic lenses.

Figure 12:
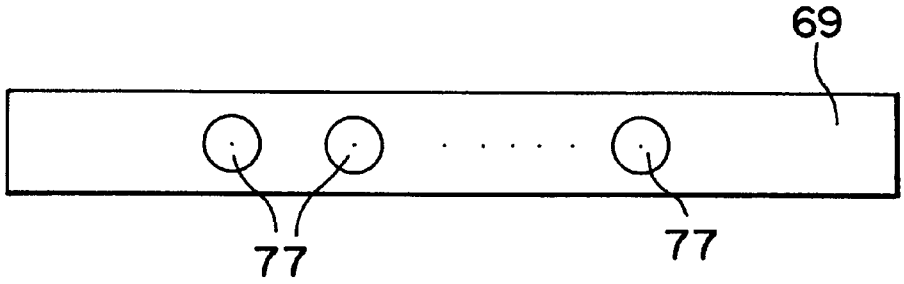

FIG. 12 is a rear elevational view of the output block of FIGS. 10–11, this view illustrating the block outputs which enable the homeowner or consumer to choose particular satellite(s) for view.

Figure 1:
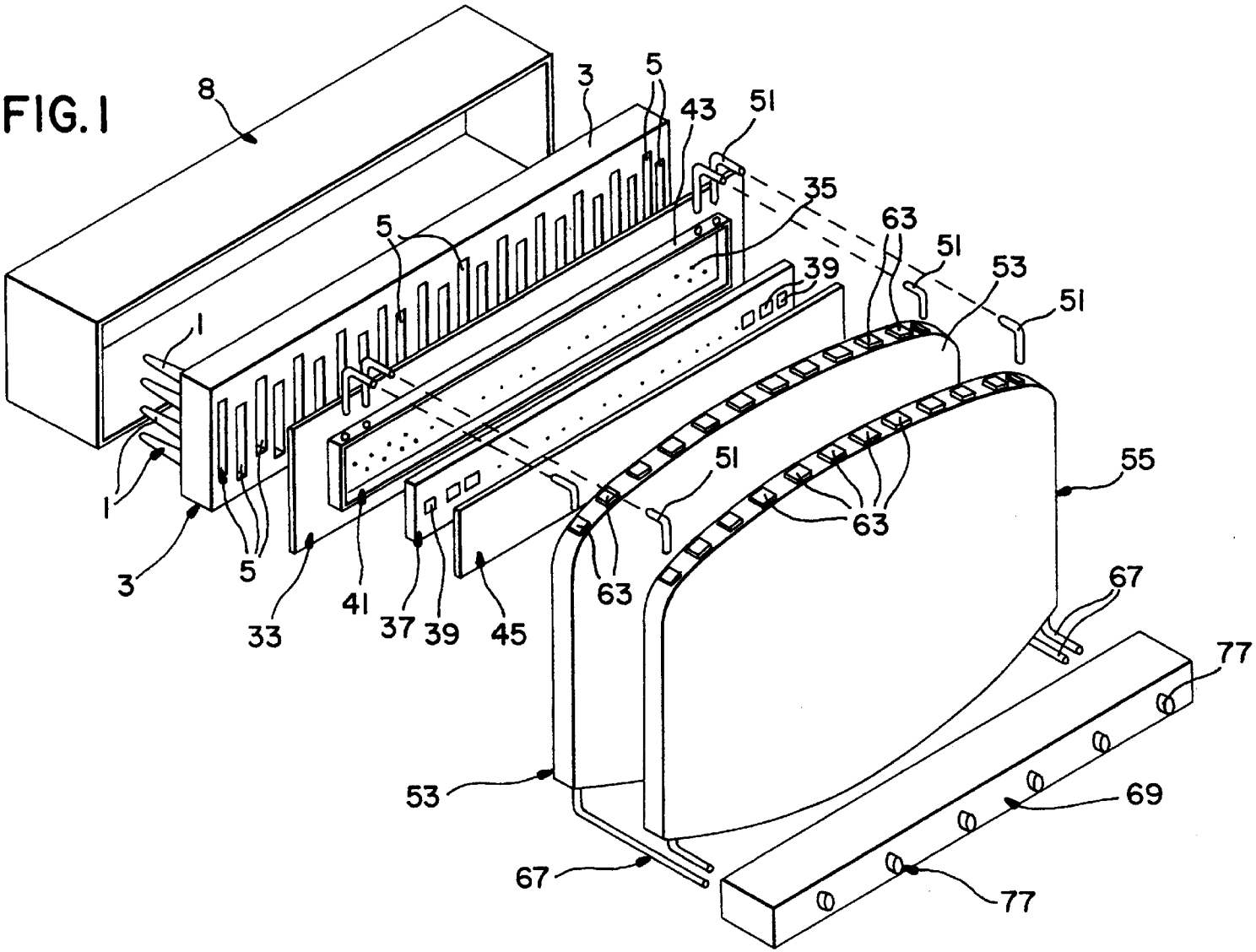
FIG. 1 is an exploded perspective view of the multiple beam array antenna system of a first embodiment of this invention.
Figure 13:
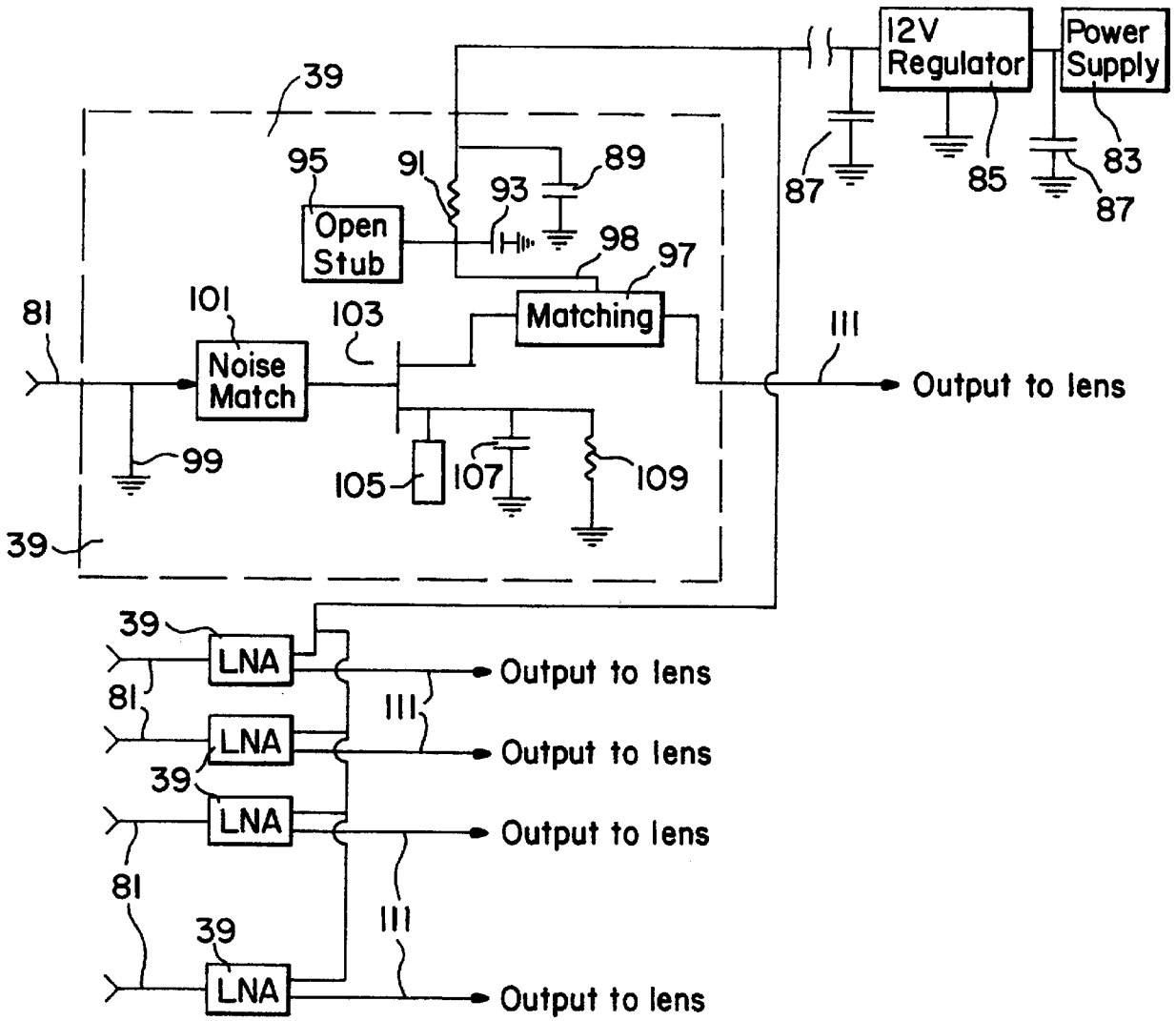

FIG. 13 is a schematic diagram of the low noise amplifiers (LNAs) according to the FIG. 1 (or FIG. 2) embodiment of this invention, where a single LNA is enlarged.

Figure 14:
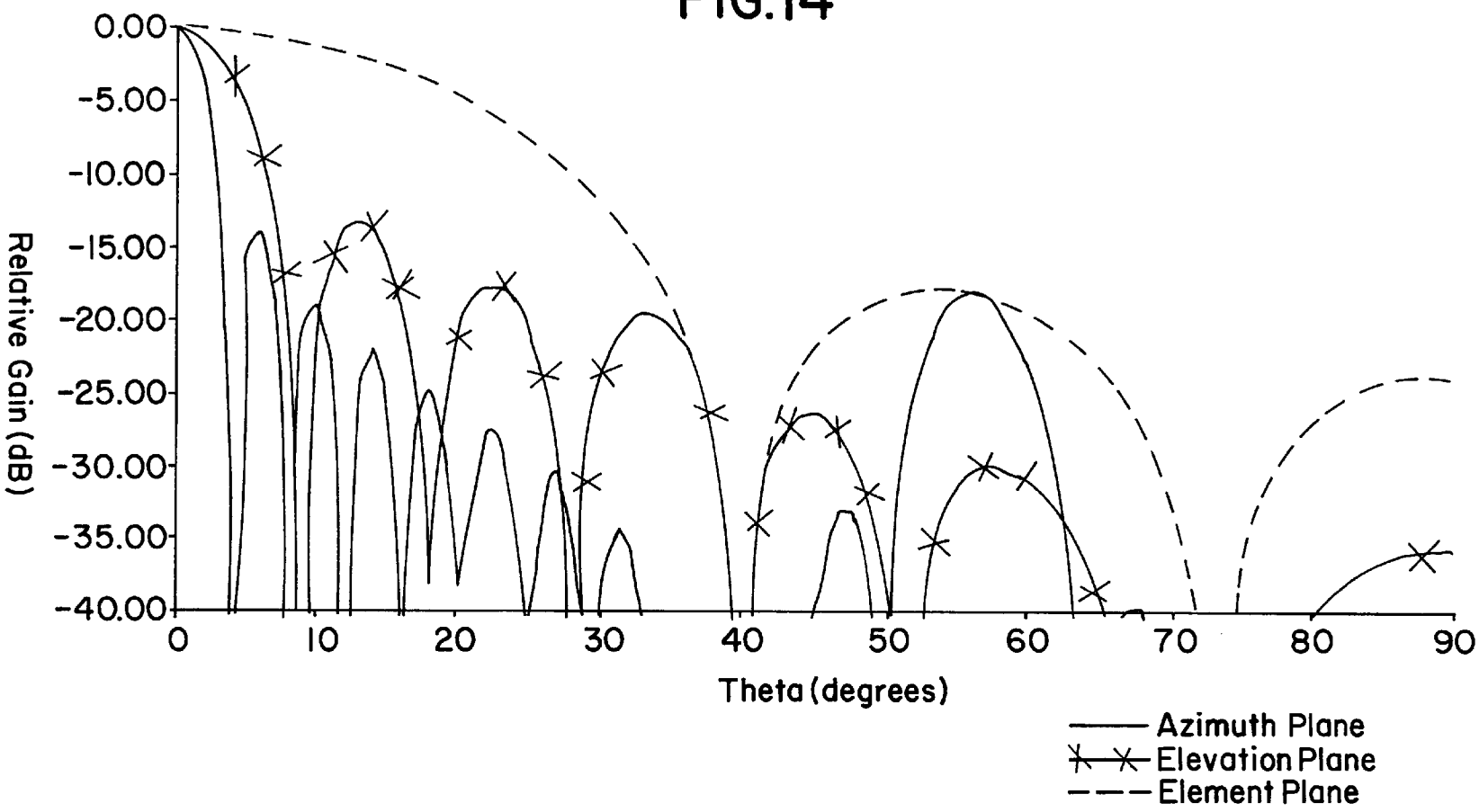

FIG. 14 is a graph illustrating a normalized theoretical radiation pattern of an antenna element and the array pattern according to the first or second embodiment from a 4×12.

Figure 15:
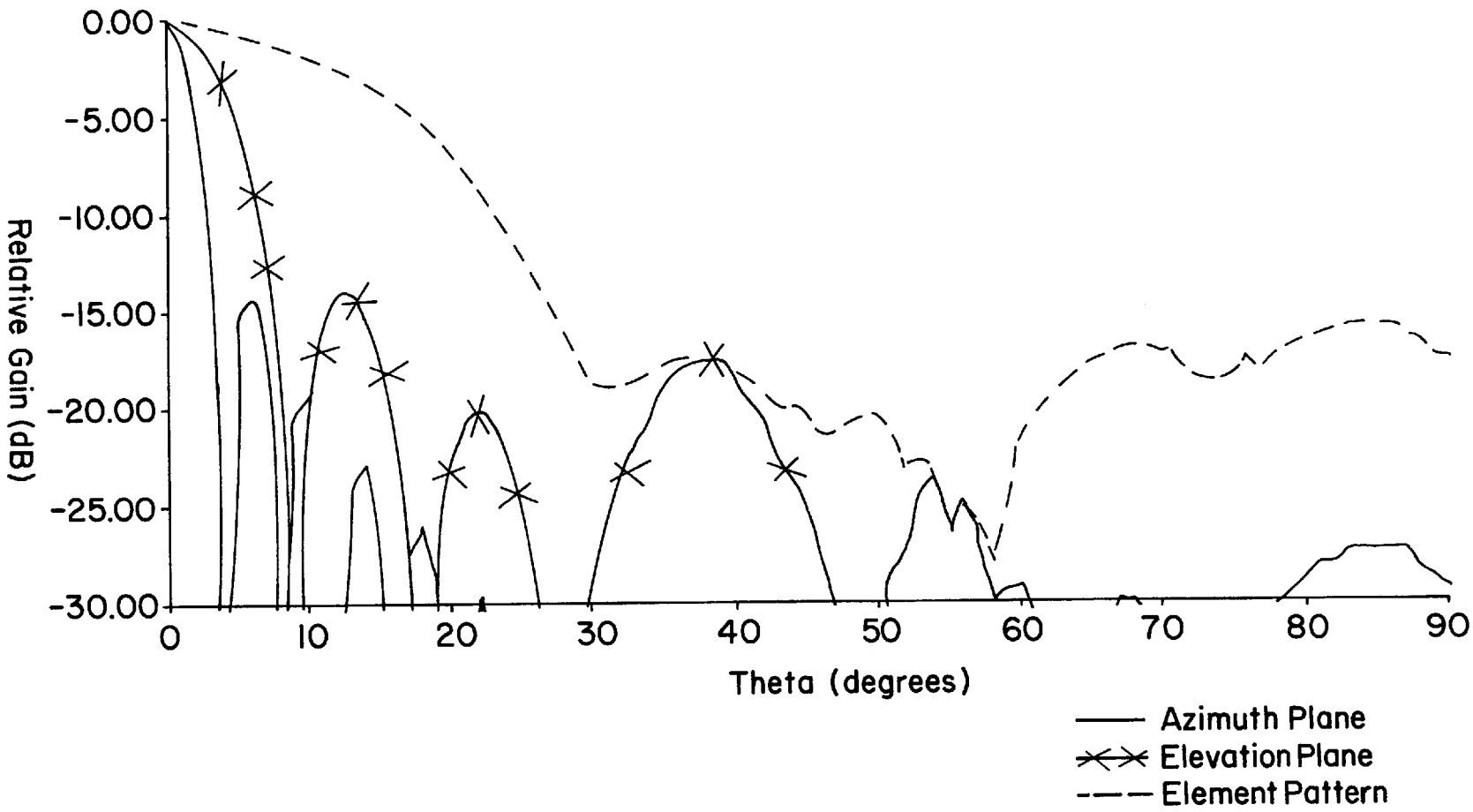

FIG. 15 is a graph illustrating a computed array radiation pattern from a measured antenna element pattern according to the first or second embodiment from a 4×12.

Figure 16:
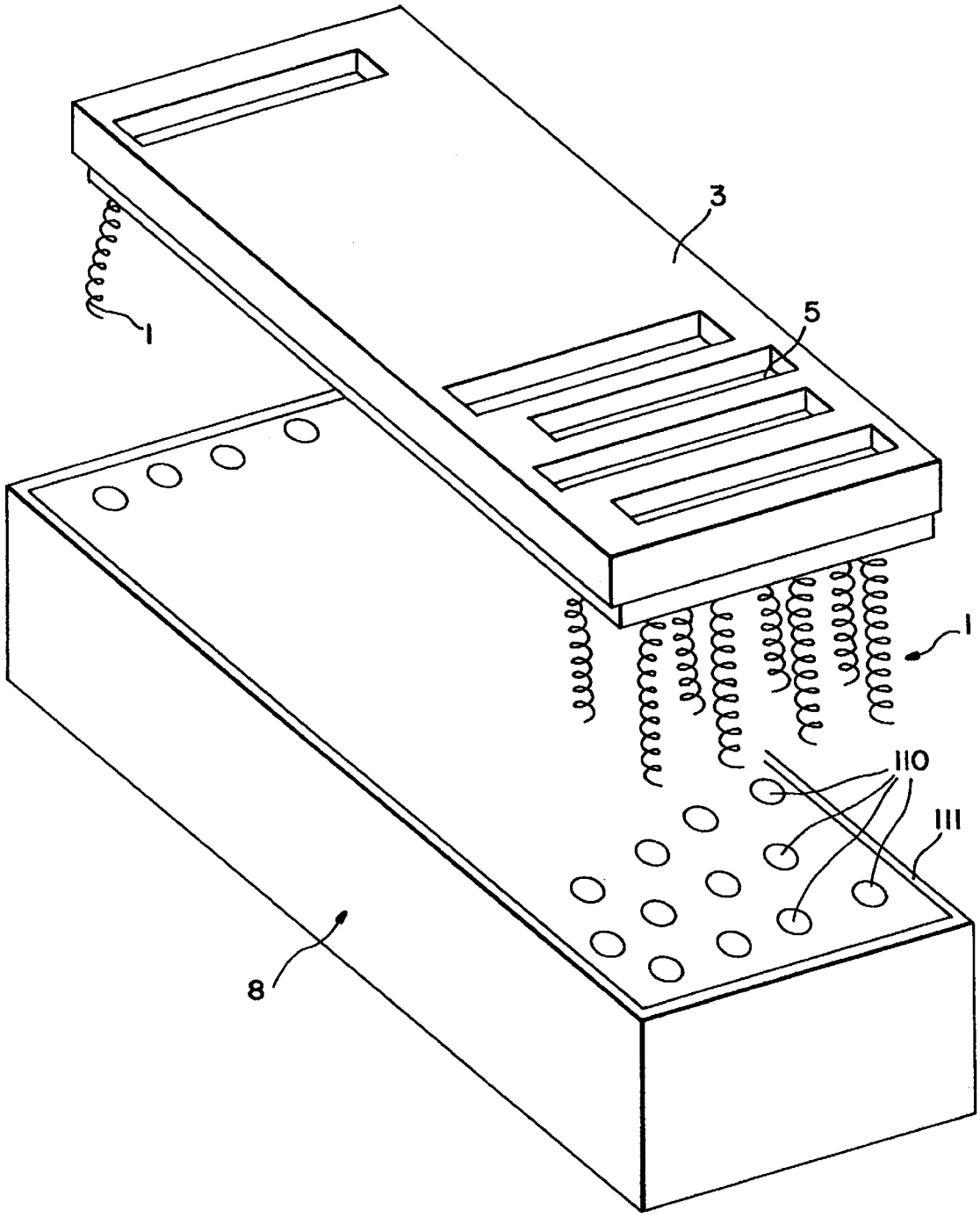

FIG. 16 is an exploded perspective view illustrating an alternative embodiment of a) radome.

Figure 18:
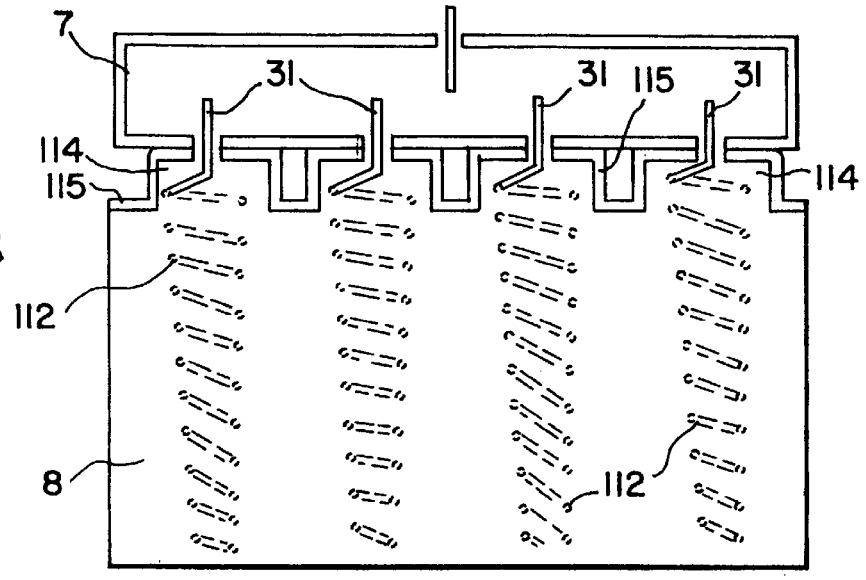
Figure 17:
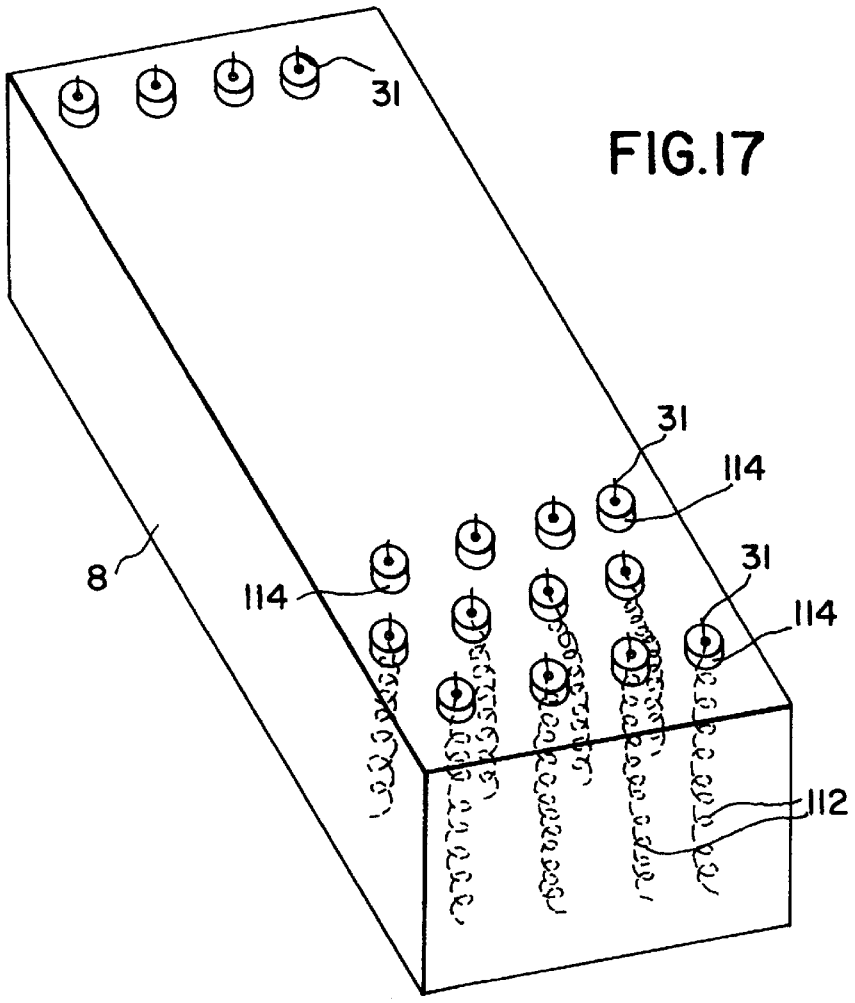

FIGS. 17 and 18 are perspective and side elevation cross-sectional views respectively of still another alternative embodiment of a radome and corresponding antenna elements.

Figures 19A, 19B, 19C, 19D, 19E, 19F:
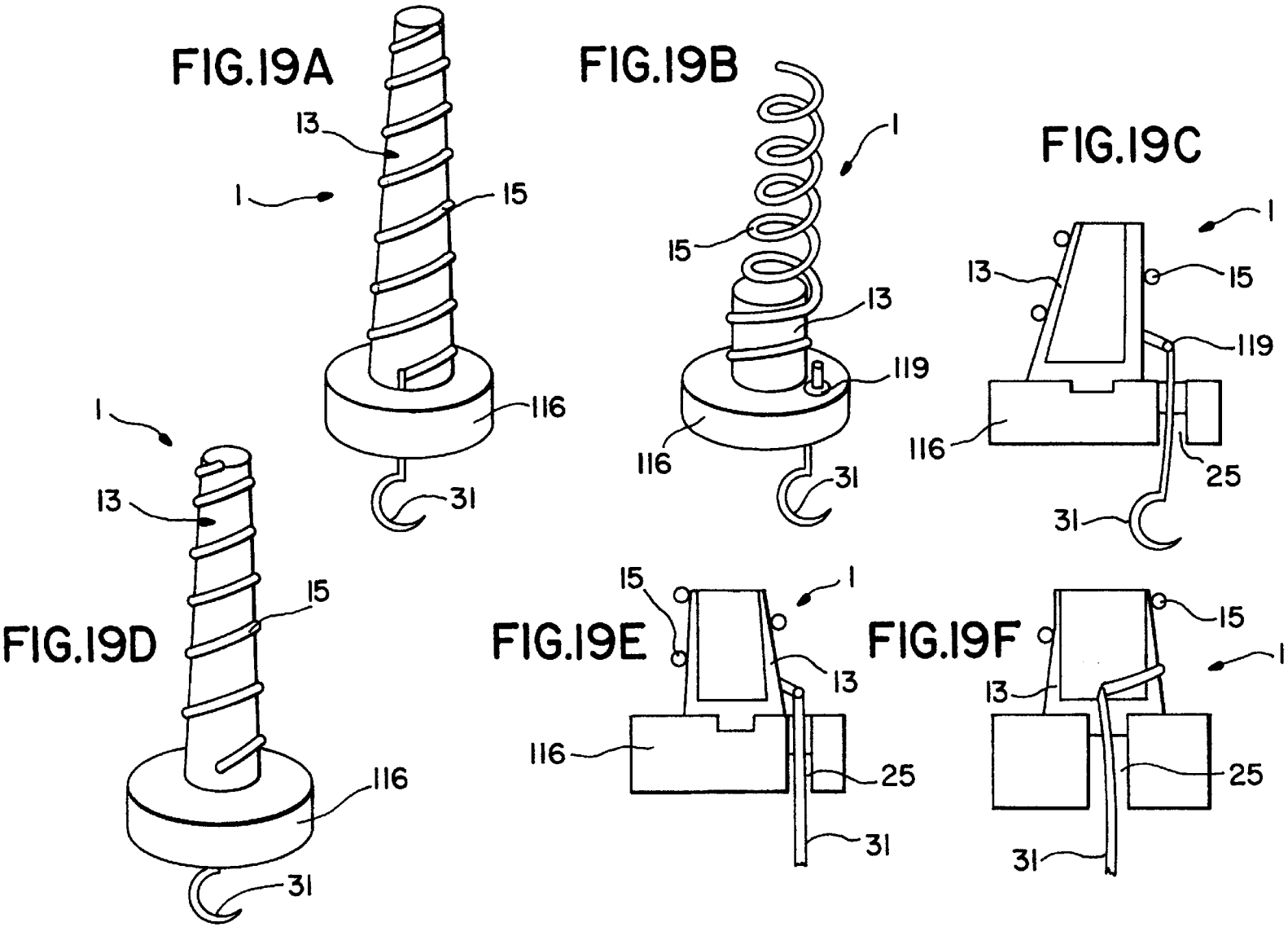

FIGS. 19(*a*)–19(*f*) are perspective and side elevational cross-sectional views of alternative embodiments of antenna elements which may be used according to this invention.

Figure 20A:
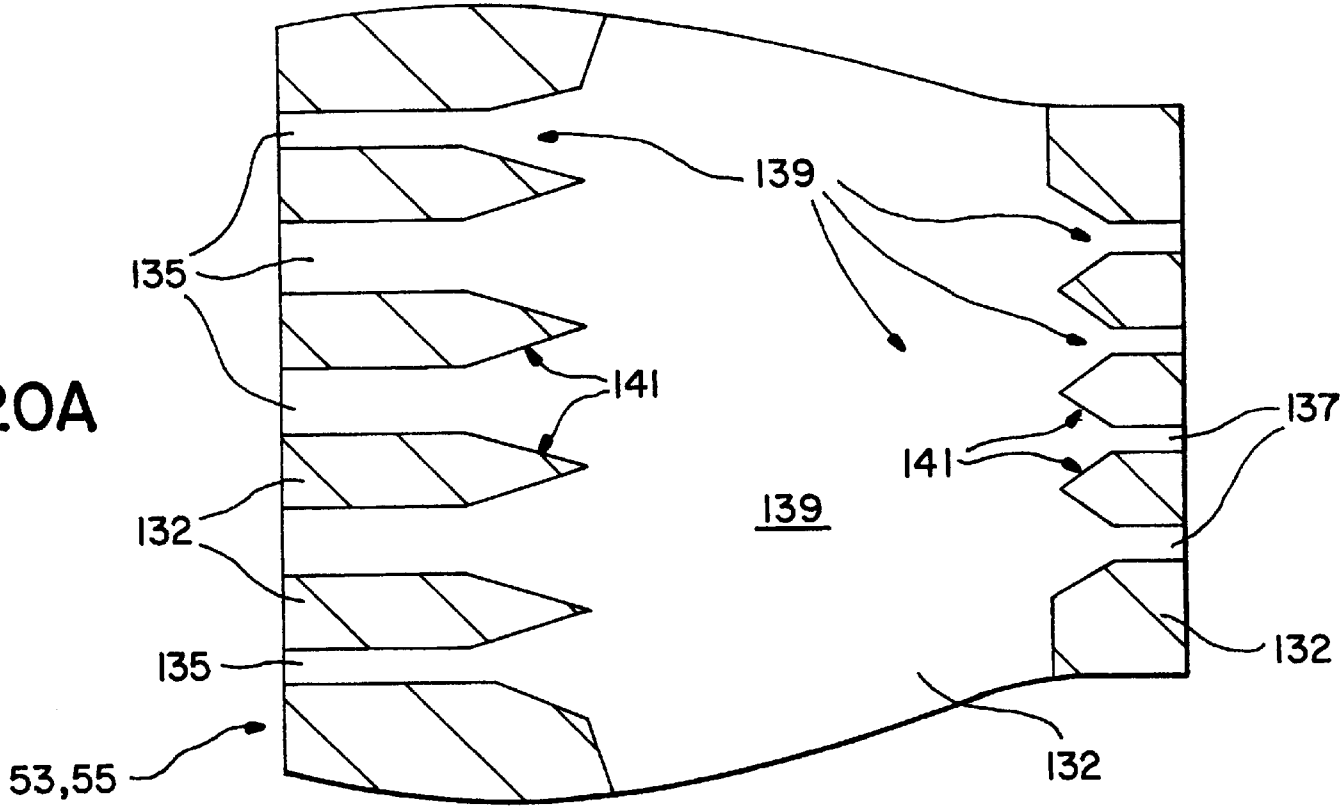
Figure 20B:
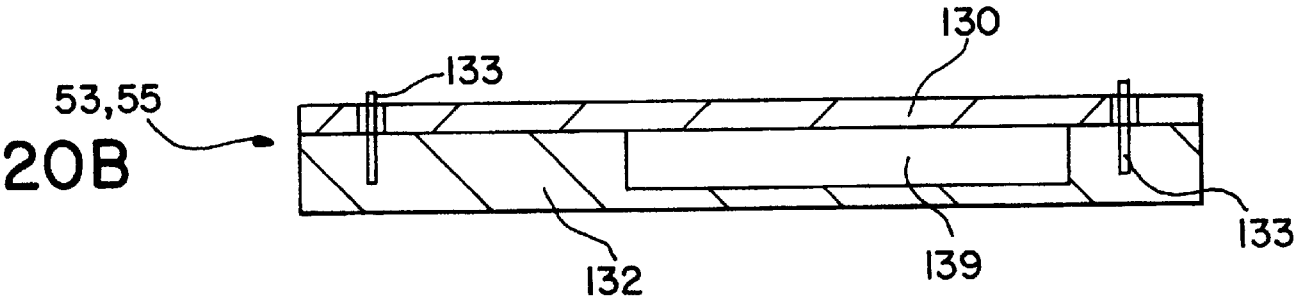

FIGS. 20(*a*)–20(*b*) are top and side cross-sectional views respectively of an alternative embodiment of a lens.

DETAILED DESCRIPTION OF CERTAIN EMBODIMENTS OF THIS INVENTION

FIG. 1 is an exploded perspective view of the multiple beam array antenna system according to a first embodiment of this invention. The system is adapted to receive signals in about the 10.70–12.75 GHz range in this and certain other embodiments. The multiple beam array antenna system of this embodiment takes advantage of restrictions in scan coverage in order to produce a high gain scanning system with few phase controls. Electromagnetic lenses (described below) are provided in combination with a switching network so as to allow the selection of a single beam or group of beams as required for specific applications.

The multiple beam array antenna systems of the different embodiments may be used in association with, for example, DBS and TVRO applications. In such cases, a beam array of relatively high directivity helical elements is provided and designed for a limited field of view. The system when used in at least DBS applications provides sufficient G/T to adequately demodulate digital or analog television downlink signals from high powered Ku band DBS satellites in geostationary orbit. Other frequency bands may also be transmitted/received. The field of view may be about ±12 degrees in certain embodiments, but may be greater or less in certain other embodiments.

With respect to the term "G/T" mentioned above, this is the figure of merit of an earth station receiving system and is expressed in dB/K. $G/T=G_{dBi}-10\ \log T$, where G is the gain of the antenna at a specified frequency and T is the receiving system effective noise temperature in degrees kelvin.

The array antenna portion includes a plurality of helical subarrays made up of antenna elements 1, element or antenna mounting plate 3, signal combining waveguides 5 (one waveguide 5 per subarray), and protective housing or radome 8. Protective housing 8 slides over antenna elements 1 and is affixed to element mounting plate 3 during use of the system so as to protect antenna elements 1. Housing 8 provides environmental protection to elements 1 and is transparent to the frequency fields (e.g. radio frequency fields) existing at the antenna aperture. Antenna elements 1, mounting plate 3, and waveguides 5 are illustrated in more detail in FIGS. 2–5.

Figure 2:
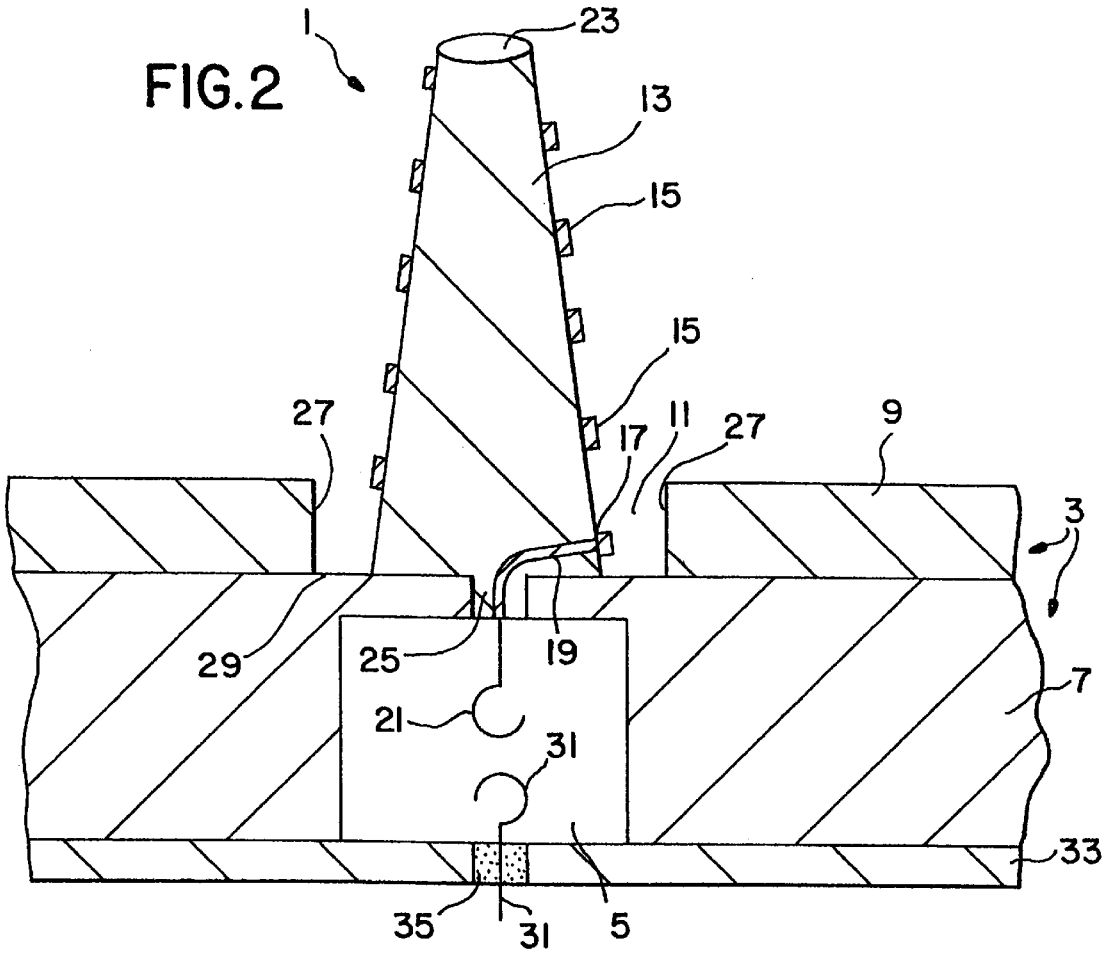
FIG. 2 is a side cross-sectional view of a single antenna element of the array coupled to a combining waveguide according to a second embodiment of this invention. This FIG. 2 embodiment is equivalent to the first or FIG. 1 embodiment except that elements 7 and 9 of FIG. 2 are formed of a single piece of milled aluminum in the FIG. 1 embodiment.

FIG. 2 is a cross-sectional side view of a single antenna element 1 in a subarray illustrating its connection to mounting plate 3 and signal summing or combining subarray waveguide 5. In this FIG. 2 embodiment, mounting plate 3 is shown as being made up of two separate members, portion 7 defining waveguide 5 and portion 9 which is a conductive ground plane defining cup aperture 11 in which element 1 is mounted. Members 7 and 9 are affixed to one another. Alternatively, and as shown in the FIG. 1 embodiment, elements 7 and 9 defining mounting plate 3 may be made of a single piece of milled aluminum or the like wherein waveguides 5 and cup apertures 11 are milled out of the aluminum piece or block making up mounting plate 3. Other conventional metals or plastics may be used instead of aluminum. Thus, the only difference between the first embodiment and the FIG. 2 embodiment is that in the FIG. 2 embodiment plate 3 is made up of two members (7 and 9) instead of one.

Antenna element 1 as shown in FIG. 2 includes tapered dielectric rod or mandrel 13 which is made of an injection moldable plastic material or the like having a substantially low loss tangent. A single wire or foil conductor 15 is wound around dielectric mandrel 13 in a helical fashion so as to define an electrically conductive helix located on the exterior surface of dielectric mandrel 13. Wire conductor 15 performs the primary electrical receiving (and transmitting) function of antenna element 1.

Conductive member 15 wound around dielectric 13 is made of copper foil including an adhesive backing in certain embodiments of this invention, the adhesive being for affixing the conductive foil 15 to dielectric mandrel 13. Such copper foil used as conductive helical member 15 may be about 1–3 mils thick and in the form of about a 50 mil strip in certain embodiments of this invention. Alternatively, wider conductive strips, copper wire or the like (e.g. painted or plated) may instead be used as conductive helical member 15 on dielectric 13.

As shown, conductive wire (or foil) 15 is wound down from the apex or zenith of tapered mandrel 13 toward the base to a point 17 where wire 15 meets and is conductively attached to wire portion 19 disposed within dielectric 13. Wire 19 extends from the outer periphery of mandrel 13 (at point 17 where it is conductively attached to wire 15) to wire element output probe 21. Element output probe 21 extends from the base of element 1 (where it is conductively connected to wire 19) into signal summing waveguide 5. All elements 1 in the array are similar to the illustrated element portrayed in FIGS. 2–4.

In certain embodiments of this invention, a small notch is cut in dielectric mandrel 13 immediately adjacent wire 15 as it extends down and around mandrel 13. This notch (not shown) scribed in mandrel 13 winds around the mandrel from its apex to its base always adjacent wire 15. This notch is for alignment purposes with respect to conductor 15.

A plurality of elements 1 make up the plurality of subarrays making up the overall array. The array geometry is designed so as to provide sufficient gain to clearly receive the satellite downlink. Sufficient gain may be taken to mean a minimum of about 31 dBi for typical Ku band TVRO satellites in certain embodiments. A gain of 27–37 dBi may be utilized, and more preferably a gain of about 30–31 dBi may be achieved in certain embodiments. However, this gain may change in accordance with the application of the system in other embodiments. Additionally, the array is designed so as to obtain adequate G/T for applicable downlink situations.

Many different array lattices may be used to obtain satisfactory gain (e.g. about 31 dBi) in the different embodiments of this invention. In certain preferred embodiments, non-symmetrical subarrays (as will be described below and shown for example in FIG. 6) are formed so as to generate a fan type beam(s) with the fan direction oriented substantially perpendicular to the geostationary orbital satellite belt in the case of DBS applications. Fan shaped beam(s) have the advantage of reducing inter-satellite interference in the absence of polarization and frequency band diversity for multiple beam earth stations.

The structural design of elements 1 is important for suppressing the grating lobes formed by the relatively sparse element spacings used in certain embodiments of this invention. The sparsely populated array in certain embodiments reduces the number of components and therefore total cost, but introduces certain radiation maxima which need to be suppressed or eliminated in order to realized substantially full array gain. Accordingly, elements 1 are designed so as to have sufficient directivity over the full DBS bandwidth so that a null (or greatly reduced radiation intensity) is produced for all angles equal to or greater than the closest approaching grating lobe. This angle is dependent upon the element 1 spacing and the maximum desired steering angle. Elements 1 spacing with respect to wavelength will be discussed below.

Furthermore, elements 1 are designed to have sufficiently low directivity over the full DBS bandwidth such that the element 1 radiation intensity at the angle corresponding to maximum steer is as high as possible (i.e. minimum pattern roll-off from maximum). Elements 1 are efficient over the full bandwidth to an extent so that they do not degrade the system G/T. The input impedances of elements 1 over the full bandwidth are substantially similar and are designed to be a convenient value of resistive impedance (e.g. about 25–100 ohms, and more preferably about 50 ohms).

In accordance with the above design requirements, in certain embodiments of this invention, tapered mandrel 13 of each element 1 may have a base diameter of about 0.321 inches at its base adjacent base 29 of cup aperture 11 (or the top surface of portion 7 as shown in FIG. 2) and a top diameter of about 0.229 inches at its apex 23. Additionally, the above-mentioned notch scribed in mandrel 13 adjacent helical wire 15 may be about 1 mil deep, the spiral spacing between wire or foil 15 along the exterior periphery of mandrel 13 (i.e. between turns) may be about 0.245 inches, and the axial length of dielectric mandrel 13 may be about 4.41 inches in certain embodiments of this invention. In these embodiments, there are about 18 turns of wire or conductor 15 from apex 23 to the base of dielectric mandrel 13.

With respect to antenna element spacing, helical antenna elements 1 within particular subarrays are spaced apart about 1.6λ and the elements 1 of adjacent (right-handed and left-handed) subarrays are spaced apart about 1.2λ in certain embodiments of this invention. In sparse arrays, element spacings may however be from about 1.0–1.8λ in certain other embodiments. When the multiple beam array antenna system is designed to receive frequencies in the range of from about 10.7 GHz to 12.75 GHz, λ (wavelength) is defined in the middle of this band (i.e. at about 11.8 GHz).

While the above listed numerical parameters are illustrative for certain embodiments of this invention, they are not limiting upon the scope of the invention. Accordingly, different element 1 parameters than those listed above may be utilized in accordance with the intended scope and need of the array antenna system in certain embodiments of this invention.

Alternatively, instead of using wire 19 to connect helical conductor 15 to probe 21, a notch may be cut in the base portion of dielectric 13 so as to allow helical winding (e.g. foil) 15 to extend into the notch to the axial center of dielectric 13 where an electrical connection may be made between wire probe 21 and winding 15. Thus, probe 21 and wire 15 may be conductively attached in the notch at the axial center of dielectric 13 without the need for wire 19 according to this alternative. Additionally, if such a notch is provided, wire 19 may extend straight upwardly from probe 21 so as to meet and connect to conductor 15.

The dielectric mandrel 13 of each antenna element 1 includes a cylindrical extension portion 25 protruding from its base so as to allow each mandrel 13 to be affixed to element mounting plate 3 (or portion 7 thereof as in the FIG. 2 embodiment). An aperture is defined in mounting plate 3 (or portion 7 in the FIG. 2 embodiment) so as to allow extension 25 of mandrel 13 to extend thereinto thus allowing the mandrel to be mounted on mounting plate 3 and fixedly disposing element output probe 21 within the confines of rectangular signal summing waveguide 5. Extension 25 also provides an impedance match between the helix and probe 21.

Conductive cup aperture 11 is defined around each antenna element 1 in mounting plate 3 (or grounding plane 9 in the FIG. 2 embodiment) for radiation mode suppression purposes as is known in the art. Each conductive ground plane cup aperture 11 adjacent each antenna element 1 in the array (and subarrays) includes a base portion 29 immediately adjacent the base of mandrel 13, a substantially circular sidewall portion 27 defining aperture 11, and a central aperture in the base portion for allowing extension 25 of mandrel 13 to extend. As shown in FIG. 2, sidewall 27 of the conductive cup may extend upward at an angle substantially perpendicular to base portion 29 of the cup. Alternatively, but not shown, sidewall 27 of the conductive cup may extend from base portion 29 toward apex 23 of mandrel 13 with linearly increasing diameter as sidewall 27 extends toward apex 23. Thus, the diameter of the cup adjacent base portion 29 will be smaller than its diameter adjacent the exterior portion of the cup closest to apex 23 of mandrel 13.

The height of sidewalls 27 defining cup aperture 11 is about one-half (½)λ and the diameter of cup aperture 11 is about three-quarter (¾)λ in certain embodiments of this invention. Accordingly, λ at, for example, 11.8 GHz is about 1 inch. Therefore, at 11.8 GHz, the diameter of cup 11 is about three-quarters inch and the height of cup 11 is about one-half inch in certain embodiments.

Figure 3:
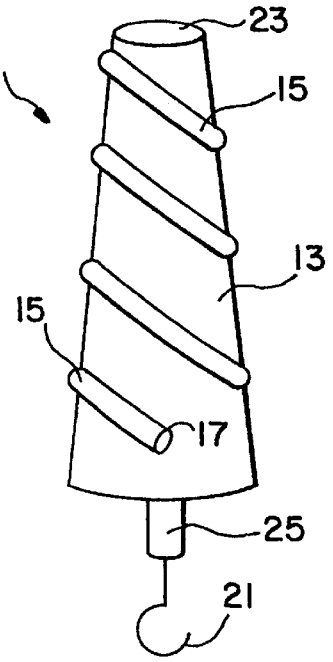
FIG. 3 is a perspective view of an antenna element of the first or second embodiment of this invention.
Figure 4:
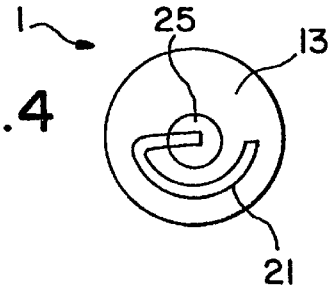
FIG. 4 is a bottom view of the antenna element of FIG. 3.

FIG. 3 is a perspective view of a single antenna element 1 including winding 15. FIG. 4 is a bottom view of an element 1 illustrating the base portion of mandrel 13, extension 25, and wire output probe 21.

The output probe 21 of each element 1 which extends into the appropriate subarray signal combining waveguide 5 may be made of copper wire having a diameter of about 0.031 inches in certain embodiments. Alternatively, any conventional conductive wire will suffice.

Figure 5:
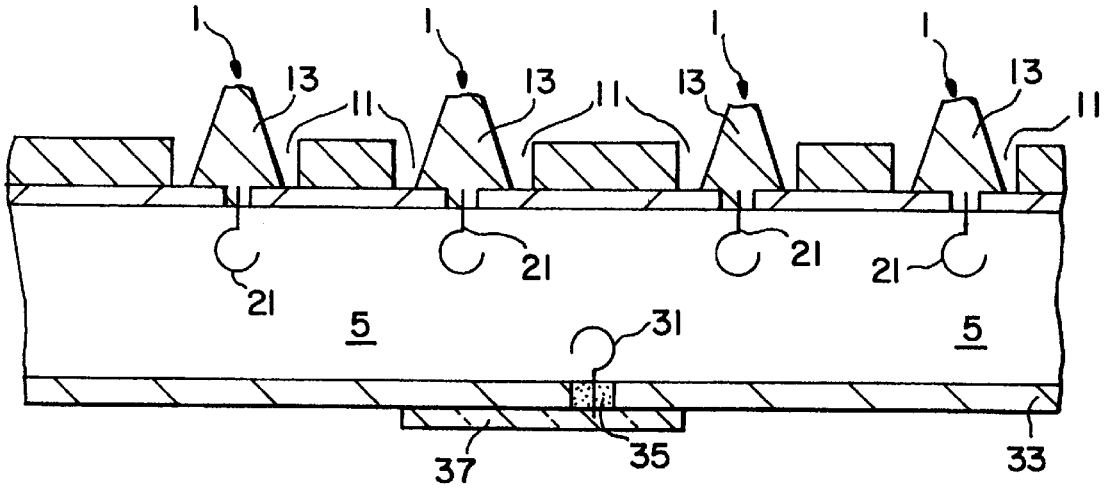
FIG. 5 is a front or rear cross-sectional view of a subarray of antenna elements positioned adjacent their corresponding combining subarray waveguide according to the FIG. 2 embodiment of this invention.
Figure 6:
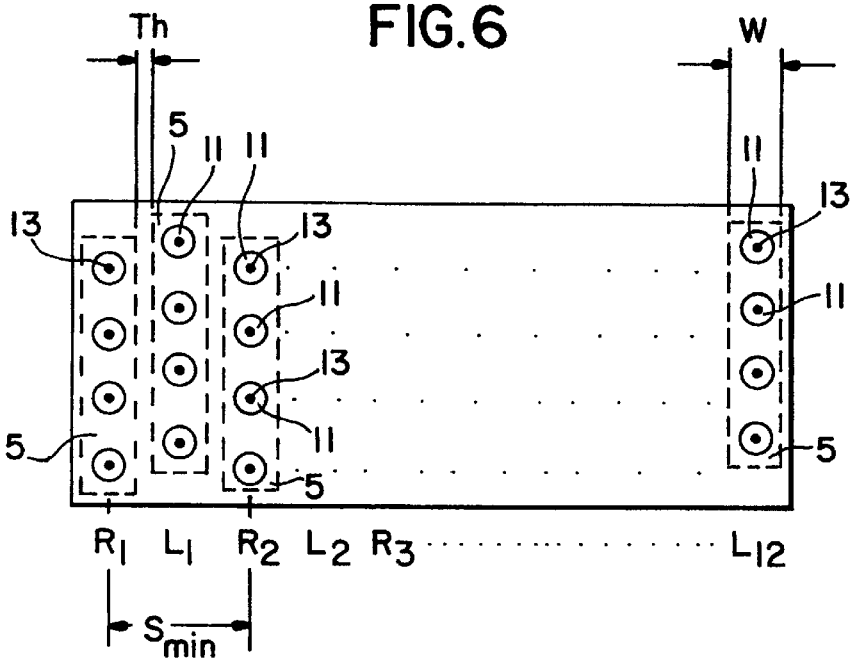
FIG. 6 is a top elevational view of the plurality of antenna elements making up the plurality of subarrays of the array antenna of either the first or second embodiment of this invention.

As shown in FIGS. 1 and 6, the antenna array of certain embodiments is made up of a plurality of subarrays, each subarray having its own signal summing waveguide 5 (see FIGS. 5–6). Each subarray is made up of four (4) similarly wound (either right-handed circularly polarized or left-handed circularly polarized) helical antenna elements 1 in certain embodiments. As is known in the art, the direction of polarization of each element 1 depends upon the direction of winding 15.

The antenna system includes twenty-four separate non-symmetrical subarrays in certain embodiments as shown in FIG. 6 in order to form the above described fan shaped beam(s), the twenty-four subarrays being made up of twelve right-handed circularly polarized subarrays and twelve left-handed circularly polarized subarrays interleaved with one another. Thus, subarrays R1, L1, R2, L2 . . . R12, and L12 are defined on the front or signal receiving surface of antenna element mounting plate 3 (subarrays R1, R2, etc. referring to right-handed subarrays and subarrays L1, L2, etc. referring to left-handed circularly polarized subarrays). It is noted that the number and symmetry of the subarrays may vary in accordance with the intended use of the system because of the gain and beam position requirements.

The provision of both right-handed and left-handed circularly polarized subarrays allows the phased array antenna system of certain embodiments of this invention to receive signals from satellites emitting either right-handed circularly polarized signals, left-handed circularly polarized signals, or linearly polarized (horizontal or vertical) signals as will be discussed below.

While FIG. 2 is a side cross-sectional view illustrating an antenna element 1 and its corresponding signal summing waveguide 5, FIG. 5 is a front or rear cross-sectional view illustrating a complete subarray having four antenna elements 1 associated with a single summing waveguide 5. As shown in FIG. 6, which is a top view of the array antenna, each subarray (i.e. R1, L1, R2, L2, . . . , R11, L11, R12, and L12) has its own signal summing waveguide 5 in which the electromagnetic signals received by each of the four elements 1 of a subarray are combined and output via subarray output probe 31 typically made of a conductive wire.

The subarray output probe 31 for each subarray (and each waveguide 5), extends from the waveguide 5 through an aperture in cover plate 33. Cover plate 33 seals the rear or lens side of the plurality of signal summing waveguides 5 of the different subarrays. The apertures in plate 33 through which probes 31 extend are filled with dielectric material 35 so as to support, and to impedance transform wire probes 31.

Cover plate 33 is made of a conductive metal in certain embodiments of this invention. Alternatively, plate 33 may be made of a plastic material with the surface adjacent waveguides 5 being coated with a conductive metal.

The signal summing waveguide 5 of each subarray may be lined with a conductive metal such as aluminum or nickel. In the FIG. 1 embodiment, waveguide 5 is milled out of a solid piece of aluminum which defines all walls of each waveguide 5 save the single wall of each waveguide 5 defined by cover plate 33. This milled aluminum member of the first embodiment also defines all of the conductive walls of the plurality of cup apertures 11.

Alternatively, portion 7 in the FIG. 2 embodiment may be made of an injected molded plastic with the walls of the cups defining apertures 11 and waveguides 5 being defined by deposited conductive metal.

With respect to the dimensions of waveguides 5, all waveguides 5 preferably have the same rectangular dimensions. For example, each waveguide 5 may be about 0.75 inches deep, about 0.40 inches wide, and about 5.55 inches long in certain embodiments of this invention.

Each element output probe 21 from the different antenna elements 1 is designed so that each probe 21 contributes, in part, to the overall electromagnetic field conditions which exist within the enclosed volume of each subarray waveguide 5. Thus, each element output probe 21 in the subarray contributes to the electromagnetic field condition which exists at output probe 31 in waveguide 5, there being only one output probe 31 for each waveguide 5 (and subarray). The net effect is that the accumulative effect of each element output probe 21 in a subarray contributes to a linear superposition of electromagnetic fields caused to exist within the spatial volume of the subarray waveguide 5. Therefore, the waveguide output signal via probe 31 is related in strength to the linear summation of the different input probe 21 signal strengths accompanied by a very small loss in strength due to ohmic and mismatch losses.

The waveguide output probe 31 of each subarray passes through cover plate 33 and is connected electrically to a low noise amplifier (LNA) circuit on printed circuit board (PCB) 37. The LNA circuit on PCB 37 is an active circuit and provides signal strength amplification for the summed signal of each subarray with very low quantities of noise or other unwanted spurious signals added to the amplified signal.

PCB 37 includes a plurality of low noise amplifiers (LNAs), each output probe 31 having its own LNA 39 on PCB 37. LNAs 39 have sufficient gain in order to overcome any losses following the LNA circuit (e.g. lens losses) and low enough noise figures to not affect the system noise temperature to any great extent.

As described above, the output from waveguides 5 is sent via output probes 31 to LNAs 39 on PCB 37 within LNA housing 41. LNA housing 41 is affixed to plate 33 and includes a walled portion 43 defining sidewalls of the housing and a cover 45. PCB 37 with LNAs 39 defined thereon is placed within the confines of housing 43 and is sealed therein by cover board or plate 45. LNAs 39 are illustrated electrically in more detail in FIG. 13.

The output 111 of each LNA 39 is sent via a conventional transmission line 51 to either electromagnetic lens 53 or 55. Lines 51 could be waveguides of proper length which are connected to the element subarray ports 135. Lenses 53 and 55 are also known in the art as parallel plate Rotman lenses. Electromagnetic lens 53 receives the output from all LNAs 39 associated with right-handed circularly polarized subarrays (R1, R2, R3, . . . ) while electromagnetic lens 55 receives all outputs of low noise amplifiers 39 associated with left-handed circularly polarized subarrays (L1, L2, L3, . . . ). Lenses 53 and 55 are non-symmetrical in certain embodiments, this meaning that the beam port arc and the feed port arc are not identical (i.e. the lens curve(s) from which the LNA inputs are fed is not equivalent to the lens arc which is connected to satellite selection matrix block 69).

Figure 7:
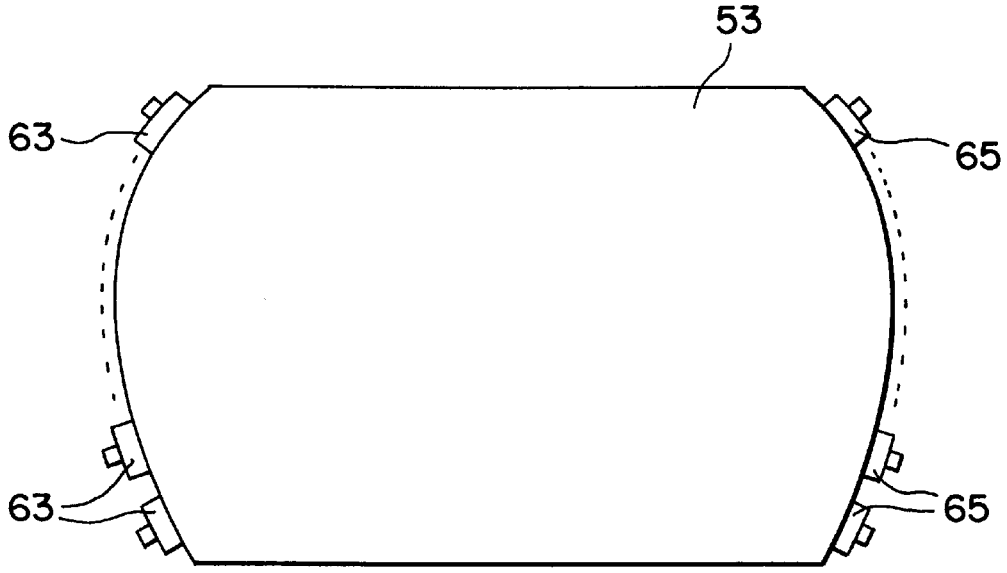
FIG. 7 is a side elevational view of either of the electromagnetic lenses of the FIG. 1 (or FIG. 2) embodiment of this invention, with the lens rotated about 90° from its position illustrated in FIG. 1.
Figure 8:
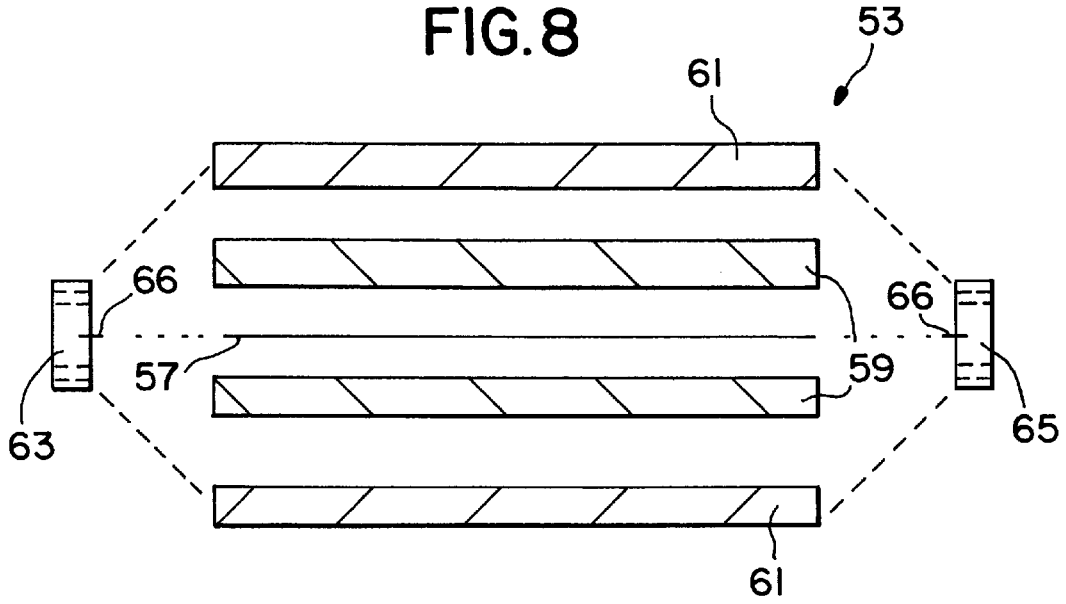
FIG. 8 is an exploded cross-sectional front view of the electromagnetic lens of FIG. 7 illustrating the layers making up the lens.

FIG. 7 is a rear or front elevational view of electromagnetic lens 53 (or 55), while FIG. 8 is an exploded cross-sectional view of lens 53 (or 55) according to a stripline embodiment. Electromagnetic lens 53 includes conductive circuit element 57, a pair of conventional dielectric substrates 59, and a pair of conductive ground planes 61. Lenses 53 and 55 are substantially identical. Conductive circuit 57 of lens 53 (and circuit 57 of lens 55) is sandwiched between dielectrics 59 with the dielectric/conductive combination being disposed between opposing ground planes 61. Alternatively, upper layers 59 and 61 may be eliminated, leaving three layers (57, 59, 61) to form a microstrip embodiment of the lens.

Each lens 53 and 55 includes a plurality of input connectors 63 (or probes) for allowing conductive circuit element 57 to be electrically connected to the low noise amplifier 39 outputs via transmission lines 51. Input connectors 63 are affixed via screws or the like to the curved input side of each lens 53 and 55. Additionally, each lens 53 and 55 includes a plurality of output connectors 65 affixed on the other curved or arc-shaped periphery thereof so as to allow the output of the lenses to be connected via transmission lines 67 to satellite selection matrix output block 69.

Connectors 63 and 65 each include a conductive portion 66 electrically connected to conductive circuit element 57 of the lens so as to allow conductivity between inputs 63 and outputs 65. Any conventional connections may be made regarding connectors 63 and 65 as well as transmission lines 51 and 67. There are twelve inputs 63 and twelve outputs 65 on each lens 53 and 55 in the embodiments of this invention which utilized twenty-four subarrays. In other words, the number of lens inputs corresponds to the number of subarrays in certain embodiments, with the number of lens 53 input ports corresponding to the number of right-handed subarrays and the number of lens 55 input ports 63 corresponding to the number of left-handed subarrays. The number of lens output ports may vary in accordance with the intended use of the system. Of course, those of ordinary skill in the art will recognize that the number of inputs 63 and outputs 65 may vary in accordance with the intended use of the system.

The arc of lenses 53 and 55 on which ports 65 are disposed may have a substantially constant radius while the curve on which ports 63 are located may not in certain embodiments.

With respect to electromagnetic lens (53 and 55) loss, lens loss may be compensated for by LNA 39 gain in a limited manner since LNAs 39 precede lenses 53 and 55. Either air or other dielectrics may be utilized in lenses 53 and 55. With respect to lens dielectric materials, air, Teflon, and FR-4 are suitable in different embodiments.

A design parameter of electromagnetic lenses 53 and 55 (i.e. Rotman lenses) is the angular increment of beam scan. This angular increment is driven by the spacing between satellites of a constellation from an earth point of view and the beamwidth of the array radiation pattern in the scanning plane. Ports 63 and 65 may be designed so that the angular increment of beam scan of each lens is about 4° in certain embodiments. This increment may, of course, change in accordance with the application of the system.

Lenses 53 and 55 are designed based at least in part upon the principles set forth in "Wide-Angle Microwave Lens for Line Source Applications" by Rotman and Turner (1962), the disclosure of which is incorporated herein by reference. The focal angle of each lens 53 and 55 is about 60 degrees and lens parameter "g" (see Rotman-Turner) is about 1 in certain embodiments of this invention.

By combining the use of lenses 53 and 55, the user may receive satellite signals from anywhere in the scanning range of either lens in any polarization sense. The scanning capability of the system is bounded by the capability of the lenses and the array. Electromagnetic or microwave lenses 53 and 55 are time-delay devices designed to scan on the basis of optical path lengths, their radiated or scanned beams being substantially fixed in space. Lenses 53 and 55 may also be termed as "constrained" lenses in certain embodiments in reference to the manner in which the electromagnetic energy passes through the lens face. Constrained lenses 53 and 55 include a plurality of radiators to collect energy at the lens "back face" and to re-radiate energy from the "front face." Within lenses 53 and 55, electromagnetic energy is constrained by transmissions lines thus allowing tailoring of scanning characteristics.

In accordance with the above described lens designs, lenses 53 and 55 in combination of the multiple beam antenna systems of this invention allow the systems to select a single beam or a group of beams for reception (i.e. home satellite television viewing). Due to the design of the antenna array and matrix block 69, right-handed circularly polarized satellite signals, left-handed circularly polarized satellite signals, and linearly polarized satellite signals within the scanned field of view may be accessed either individually or in groups. Thus, either a single or a plurality of such satellite signals may be simultaneously received and accessed (e.g. for viewing, etc.).

The multiple beam array is configured in a 4×12 fashion in the first embodiment of this invention, the number 4 representing the number of helical elements in a subarray and the number 12 representing the number of subarrays corresponding to a particular polarity (either right-handed or left-handed). The non-symmetrical aspect of such a 4×12 array necessitates the above described fan-shaped beam from the array which is narrow in one direction (i.e. the East-West direction) and wider in another direction (i.e. the North-South direction). The fan-shaped beam of the antenna at half-power beamwidth is about 3° in the East-West direction and about 10° in the North-South direction as a result of this non-symmetrical arrangement of subarrays in certain embodiments of this invention. While the 4×12 parameter of subarrays is used as an example, other configurations may also be utilized, the parameters being determined in accordance with the intended use of the system. For example, a pair or more of identical 4×12 modular plates 3 with elements 1 and radomes 8 may be stacked on top of one another with their outputs being combined from their waveguides 5 through the use of an additional waveguide combiner creating 12 RH and 12 LH outputs, such outputs being fed in the normal fashion to LNA assembly 33. Thus, R1 from the first plate 3 will be combined with R1 from the second plate, etc.

Beam forming may be accomplished in certain other embodiments by varying the amplitude and/or phase of elements of symmetrical or asymmetrical arrays.

FIG. 14 is a graph illustrating the theoretical directivity of the 4×12 phased array antenna of the first embodiment of this invention, and the directivity of a single tapered antenna element 1. Side lobes and grating lobe(s) are also illustrated. It is noted that elements 1 of the multi-beam array of certain embodiments of this invention are tapered or conical in shape because it is desired to have the immediate side lobes at least about 20 dB down with respect to the main lobe.

The graph for the azimuth plane in FIG. 14 (and FIG. 15) is indicative of the fan-shaped beam in the East-West direction and the elevation plane is indicative of the North-South direction. As shown, the beam is at least about twice as wide in the elevation plane as in the azimuth plane in this embodiment. This is because as described above satellites are typically positioned in orbit along an arc defined in the azimuth plane. Therefore, the thin profile of the beam in the East-West direction (or in the satellite arc) allows reduced interference between satellites.

As shown in FIG. 14, the main lobe in the East-West (or azimuth plane) extends about 3° from normal (0°) at about 20 dB down while the main lobe in the elevation plane extends about 7°–8° from normal. Multiple side lobes are shown for both planes from about 4°–35° in the azimuth plane and from about 9°–50° in the elevation plane. Additionally, a grating lobe in the azimuth plane is shown beginning at about 51° reaching a peak at the element pattern and ending at about 63°.

FIG. 15 illustrates computed array patterns from an actual measured element pattern, this figure illustrating the array antenna system having a directivity of about 30.45 dBi. This graph was based upon the measured characteristics of a particular element 1 which were input into a simulation program for simulating a 4×12 array design of the first embodiment. The main lobes and numerous side lobes are shown in both the elevation and azimuth planes and in addition a grating lobe is shown in the elevation plane starting at about 30°. The element pattern derived in coming up with the graph of FIG. 15 was taken at a frequency of about 11.95 GHz. For maximum gain the grating lobes are suppressed if they are positioned just outside of the element pattern. It is noted that FIGS. 14 and 15 were derived using a 1.6λ (or 1.6 inch) element spacing within subarrays (in the Y direction) and a 1.2λ or 1.2 inch spacing in the X direction (adjacent subarrays).

Directivity is a function of the number of elements 1 employed and the area over which they are positioned. Larger directivities require larger element areas in general and typically more elements. However, for limited scan applications such as the first embodiment of this invention, the element lattice may be sparsely populated and still achieve a high level of directivity, with the tradeoff involving ensuring that no or substantially no grating lobes are formed at any steering angle of the array. Grating lobe formation reduces the array directivity in the pertinent direction as is known in the art.

Grating lobes exist in an array when more than one possible field pattern maximum exists. Grating lobes can be completely prevented by selecting an array element spacing of 0.5λ or less. Alternatively, and as carried out in the first embodiment, grating lobes are suppressed by utilizing helical elements 1 in making up the array and subarrays wherein each element 1 has an element in such a case pattern which is relatively small or reduced in regions where the grating lobes exist. Accordingly, in such a pattern multiplication necessitates that the array grating lobes are reduced in intensity to the level of element sidelobes or lower and therefore do not adversely impact the array gain. Thus, each element 1 is designed so as to provide a null (or at least about a 20 dB reduction in relative radiation intensity) at the angular position corresponding to grating lobe position(s).

FIG. 9(*a*) is a schematic diagram of the multi-beam array antenna system of certain embodiments (e.g. the first embodiment) of this invention. As shown, the signal is received by either the right-handed or left-handed subarray elements 1, or both. Thereafter, the signals received by elements 1 in a particular subarray are summed in a waveguide 5, the combined signals of each subarray then being sent to a low noise amplifier 39. After amplification, the signals from the left-handed subarrays are sent to lens 55 while the signals from the right-handed subarrays are sent to lens 53. Satellite selection matrix output block 69 then allows the user to select from which satellite(s) he wishes to receive signals.

Output block 69 accommodates the location of the user and the constellation of the satellites of interest to the user. Because satellite spacing of a given constellation is different in different regions or viewing angles, block 69 may be adjusted so as to allow the user to view certain satellite(s), the adjustment of block 69 being a function of the region and constellation of satellites of interest in which the system is to be located.

FIG. 9(*b*) illustrates the case where the user manipulates satellite selection matrix output block 69 to simply pick up the signal from a particular satellite which is transmitting a right-handed circularly polarized signal. In such a case, the path length in lens 53 is adjusted so as to tap into the signal of the desired satellite.

FIG. 9(*c*) illustrates the case where a plurality of received outputs from lens 55 (left-handed circularly polarized) are summed or combined in amplitude and phase. Summing adjacent ports of lens 55 (or 53) splits the steps size of the lens. The signals from two adjacent outputs 65 are combined at summer 71 so as to split the beams from the adjacent output ports 65. Thus, if the viewer wishes to view a satellite disposed angularly between adjacent output ports 65, output block 69 takes the output from the adjacent ports 65 and sums them at summer 71 thereby "splitting" the beam and receiving the desired satellite signal. It is noted that a small loss of power may occur when signals from adjacent ports 65 are summed in this manner.

For example, when the granularity of the array is 4° apart, the step size of lenses 53 and 55 could be designed conveniently to be about 4° in certain embodiments. When two satellites are spaced 6° apart, the signal from one satellite may be received via one port 65. However, the signal from the second satellite is received by summing adjacent ports 65 so as to split their beam and obtain a signal disposed in the middle thereof.

FIG. 9(*d*) illustrates the case where outputs 65 from both lenses 53 and 55 are tapped so as to result in the receiving of a signal from a satellite having linear polarization. Output from port 65 from right-handed lens 53 is adjusted in phase at phase shifter 73 and thereafter combined with the signal from lens 55 at summer 71. Thus, the output from matrix output block 69 is indicative of the linearly polarized signal received from a particular satellite, the position of the satellite being determined by the ports of lenses 53 and 55 tapped and thus the lens path lengths. According to certain alternative embodiments, phase shifter 73 and summer 71 may be replaced with a quadrature hybrid or other similar functioning device in order to obtain both senses of linear polarization.

FIG. 9(*e*) illustrates the case where it is desired to access a satellite disposed between the beams of adjacent ports 65 wherein the satellite emits a signal having linear polarization. Adjacent ports 65 are accessed in each of lenses 53 and 55 and are summed accordingly at summers 75. Thereafter, phase shifter 73 adjusts the phase of the signal from lens 53 and the signals from lenses 53 and 55 are combined at summer 71 thereafter outputting a signal from output block 69 indicative of the received linearly polarized signal.

Thus, the provision of electromagnetic lenses 53 and 55 allows the user to use the same array antenna elements 1 making up the overall array to view beams from different satellites. Additionally, lenses 53 and 55 allow the user to use the same elements 1 to simultaneously view plural beams from different satellites with substantially no reduction in power. In other words, matrix output block 69 and lenses 53 and 55 allow a user or consumer to tap into signals from a plurality of satellites simultaneously, the different signals received being of the right-handed circularly polarized-type, left-handed circularly polarized-type, linearly polarized-type, or different combinations thereof.

Therefore, the design of the multi-beam array antenna system of certain embodiments of this invention allows the user to, for example, simultaneously view signals from satellites A and B, where satellite A outputs a right-handed circularly polarized signal and satellite B outputs a left-handed circularly polarized signal. Matrix output block 69 may simultaneously access the two signals via lenses 53 and 55 and output the two signals over different paths to the user or consumer.

Alternatively, the user may simultaneously receive signals from satellites C and D where satellite C emits a linearly polarized signal and satellite D emits a right-handed circularly polarized signal. The reception of such signals simultaneously is carried out as described above with output block 69 accessing appropriate outputs or ports 65 from lenses 53 and 55 in accordance with the particular satellites to which viewing is desirable.

The multiple electromagnetic lenses utilized provide the necessary wave propagation control to vary the spacial position of the array apertures multiple directions of sensitivity. While two such lenses 53 and 55 are utilized in the above-described embodiments, more such lenses may be added in accordance with the intended use of the system. In such a case, output block 69 still acts to select the specific spacial and polarization characteristics of signals that will be transferred from the lenses to the receiver/user.

Another possible function of block 69 shown in FIG. 9(*f*) is to reduce interfering signals from adjacent satellites. When the antenna is aimed at the desired satellite, a weaker interfering signal can also be received when satellite spacing is small. This interfering effect is removed by subtracting from composite signal 200 a signal that is identical to the interfering signal. This is accomplished by taking output 201 of lens 53 which aims at the interfering satellite, adjusting its phase with phase shifter 202 and its amplitude with a variable loss 203 and then summing the signals in summer 204. Either or both of shifter 202 and variable loss 203 may be incorporated into a feedback loop which automatically adjusts the phase shifter and loss for minimal interference.

FIGS. 10–12 illustrate different views of satellite selection block 69. FIG. 10 is a top view illustrating inputs 75 which allow the switching matrix within block 69 to control and access the output ports of lenses 53 and 55. Outputs 77 are also shown, these outputs allowing the user to tap into desired satellite signals.

FIG. 13 is a circuit diagram of printed circuit board 37 and the multiplicity of low noise amplifiers 39 (LNA) thereon. Printed circuit board 37 may be manufactured by either Rodgers, Arlon, or Taconics Corp. and may have the following characteristics in certain embodiments: 0.020 inches thick; both sides copper clad with ½ oz. copper; and PTEE $E_r$ 2.2.

Each LNA 39 receives an input 81 from the waveguide 5 of a particular subarray (either right-handed or left-handed). One such LNA in FIG. 13 is enlarged so as to show different circuit elements thereof, each LNA 39 being substantially similar to the enlarged LNA illustrated.

Each LNA 39 is driven from power supply 83 which is a 14–24 volt DC source in certain embodiments. The LNA assembly and power regulation thereof includes 12 volt regulator 85 and 0.3 $\mu$F capacitors 87. Each LNA 39 includes 0.1 $\mu$F capacitor 89, 1,000 ohm (and one-eighth watt) resistor 91, 100 pF capacitor 93, one-quarter wave open stub 95 having an impedance of about 30 ohms, output matching network 97, one-quarter wave grounded or closed stub 99 having an impedance of about 200 ohms, noise matching system 101, high electron mobility transistor (HEMT) 103, one-quarter wave open stub 105 having an impedance of about 30 ohms, 100 pF capacitor 107, 25 ohm (and one-eighth watt) resistor 109, and output 111 which leads to one of electromagnetic lenses 53 and 55. Trace 98 is a quarter wave trace having an impedance of about 200Ω. HEMT 103 may be NEC Part No. 42484A; NEC Part No. 76083 (GaAs FET); or conventional Mitsubishi or Fujitsu HEMTS in certain embodiments.

The above-described LNA parameters are illustrative of one embodiment of this invention. It will be recognized by those of skill in the art that the parameters and sometimes the design of LNAs 39 may be varied in certain other embodiments.

Alternatively, instead of the illustrated single stage LNA, a double-stage LNA may instead be used so as to increase the carrier to noise ratio and G/T.

An advantage of the array antenna systems of the different embodiments of this invention is their modular characteristics. While the antenna array of the FIG. 1 embodiment includes twenty-four separate subarrays, additional subarrays may be stacked on top of (or adjacent to in certain embodiments) the existing subarrays of the FIG. 1 embodiment so as to increase the received signal power. The signals output from the newly added subarrays are combined with existing subarray signals prior to the LNA input using waveguide combiners so as to save cost. Thus, the gain of the antenna may be significantly increased (e.g. doubled) simply by stacking additional subarrays on top of the existing subarrays without significantly increasing the cost of the system. The modular advantages of the system are particularly useful in regions requiring access to direct broadcast television satellites. Such satellites exhibit different signal strengths in different regions. Therefore, the need for increased gain is present in regions experiencing low strength signals from the satellites. Accordingly, in such regions in need of increased gain, additional subarrays may be stacked upon the existing ones so as to satisfy such customers.

In a typical operation of the multiple beam array antenna system of the first embodiment of this invention, travelling electromagnetic waves (e.g. from satellites) are incident upon windings 15 of antenna elements 1 making up the different subarrays of the array antenna. Additionally, the travelling electromagnetic waves are incident on conducting ground plane 9 and cup apertures 11. These waves cause electrical signal currents to be passed through windings 15 on mandrel 13 and via wires 19 (one per mandrel) to element output probes 21.

Elements 1 of right-handed subarrays (R1, R2, R3, . . . ) receive right-handed circularly polarized waves from satellites while elements 1 of left-handed subarrays (L1, L2, L3, . . . ) receive left-handed circularly polarized signals along with linearly polarized signals. The signals from these waves proceed as described above to probe outputs 21 disposed within subarray waveguides 5.

In waveguides 5, the electromagnetic waves from the plurality of elements 1 making up each subarray are combined or summed in a subarray waveguide 5 thus forming a summed electromagnetic wave bounded by the waveguide conductive walls. The bounded electromagnetic wave within each waveguide 5 exists in spacial close proximity to waveguide output probe 31 thus causing the combined signal currents to flow through probe 31 to a corresponding low noise amplifier 39 disposed on circuit board 37. The output from each waveguide 5 is sent to a different LNA 39.

The summed signal output from each subarray waveguide 5 proceeds to its own LNA input 81 and is thereafter amplified by the amplifier. The output of each LNA proceeds to a corresponding electromagnetic lens input 63. The combined signals from the right-handed circularly polarized subarrays (and their LNAs) proceed to electromagnetic lens 53 while the signals from the left-handed circularly polarized subarrays (and their LNAs) go to electromagnetic lens 55. Lenses 53 and 55 are substantially identical in design.

Now, let us assume that the user wishes to receive a television signal from a single satellite in orbit, this satellite transmitting right-handed circularly polarized signals. In such a case, the user manipulates satellite selection matrix output block 69 so as to access the signals of only this particular satellite. When matrix output block 69 receives such instructions, it accesses the particular output(s) 65 on right-handed lens 53 so as to "tap into" the signal of this particular satellite. Thus, only the signal from this particular right-handed satellite is presented to the viewer via block 69 for viewing.

Let us now assume that the user wishes to simultaneously access signals from two different satellites in orbit, the first satellite "A" transmitting linearly polarized waves and the second satellite "B" transmitting left-handed circularly polarized waves. In such a case, the user manipulates output block 69 so as to tap into the signals of both satellites "A" and "B" simultaneously via lenses 53 and 55. The matrix within output block 69 in order to allow the user to tap into the linearly polarized satellite signals from satellite "A", accesses corresponding outputs 65 from both lenses 53 and 55 as shown in FIG. 9(*d*). Thereafter, the signal from lens 53 (or alternatively lens 55) is phase shifted at shifter 73 with the phase shifted signal and the ordinary signal from lens 55 being combined at summer 71 so as to form the output in accordance with satellite "A". Simultaneously, a different output port 65 from lens 55 is accessed via the matrix within block 69 so as to tap into the received left-handed polarized signal of satellite "B". Both signals may simultaneously be output from block 69 so that the user may utilize both signals at the same time. If both satellites "A" and "B" are of the television transmitting type, then the user is able to view two different programs simultaneously, one from satellite "A" and one from satellite "B". In other circumstances, when, for example, satellite "B" is outputting music signals, the user is able to simultaneously access the television signal from satellite "A" and the music signal (or other data signal) from satellite "B".

In yet another embodiment of this invention horizontal and vertical linearly polarized antenna elements are utilized and manipulated (instead of the right and left-handed circularly polarized elements of the previous embodiments) for receiving each of the right-handed circularly polarized signals, left-handed circularly polarized signals, and linearly (horizontal and vertical) polarized signals.

FIG. 16 is an exploded perspective view illustrating an alternative embodiment of radome 8 where it is constructed of polystyrene foam having cylindrical or conical recesses 110 defined therein for the purpose of accommodating or housing corresponding antenna elements 1. A thin (e.g. less than about 0.02 inches) dielectric sheet 111 of plastic or the like may be used to cover the foam of radome 8, or alternatively radome 8 may be painted with a non-metallic paint 111. Radome 8 including apertures or holes 110 defined therein protects antenna elements 1 from both physical damage and climate related problems.

FIGS. 17–18 are perspective and side elevational cross-sectional views respectively of still a further alternative embodiment of radome 8. As shown in FIGS. 17–18, the polystyrene foam making up radome 8 is formed around suspended wire wound helical antennas 112 which take the place of antenna elements 1 in previous embodiments. Here, manufacturing is made simpler and vibration problems reduced because antenna elements 112 are embedded or bonded in the foam of radone 8 so that no air surrounds the elements 112. Also, washers are not needed adjacent elements 112. In this embodiment, cups 114 are integrally formed with radome 8 of polystyrene foam. Cups 114, which need to be conductive, may be covered with metal sheet, foil, or another known conductive coating 115 so that cups 114 of radome 8 effectively take the place of cups 11 discussed above with respect to previous embodiments. As shown in FIG. 18, probes 31 from helical antennas 112 protrude into waveguide 7, where probes 31 may be either hook-shaped or straight.

Hook-shaped probes 31 are preferably used when the probe couples energy to waveguide or combiner 7 through the narrow wall of the waveguide, while straight probes 31 are used when the probe couples energy to combiner 7 through the widest wall of the waveguide. More specifically, hook-shaped probes 31 are used when $S_{min}$ (see FIG. 6) is not large enough to support the $TE_{10}$ mode, dependent upon the required operational frequencies and bandwidth. When the array element spacing $S_{min}$ is large enough for placing the wide walls of the combiners side by side, straight probes can be implemented. In this embodiment, hook probes 31 are used when $S_{min}$ is from about 1.0 to 1.5 inches given a wall thickness "Th" (see FIG. 6) of 0.1 inches: $S_{min}$ is defined by $S_{min}$=2W+0.2" where "W" is the width of a waveguide 5 as shown in FIG. 6 and 0.2" is two times "Th." However, when $S_{min}$=2W+0.2"≧1.5 inches, then straight probes 31 are used instead of hook-shaped probes 31. W may be 0.65" for straight probes and 0.40" for hooked probes 31, thereby indicating whether the probe enters the waveguide 7 via the narrow (W=0.40") or wide (W=0.65") wall.

FIGS. 19(*a*)–19(*f*) disclose alternative configurations or embodiments for antenna elements 1. Elements 1 in FIG. 19(*a*) are formed from conductive tape 15 or the like wrapped around and on dielectric plastic or foam mandrel 13 which is mounted to metal washer 116. Probes 31 extending downward may be either straight (FIGS. 19(*e*)–19(*f*)) or hook-shaped (FIGS. 19(*a*)–19(*d*)). FIG. 19(*b*) depicts elements 1 formed using conductive wire 15 peripherally or side fed through washer 116. The FIG. 19(*b*) embodiment utilizes a short hollow dielectric stub 13 to form a mechanical support for wire 15 instead of the lengthy solid (or hollow) mandrel 13 of FIG. 19(*a*). FIG. 19(*c*) is a cross-sectional view of the FIG. 19(*b*) element showing how washer 116 is used for impedance matching.

FIGS. 19(*e*) and 19(*f*) illustrate similar cross-sectional views where probe 31 is fed peripherally and centrally respectively, probe 31 in FIGS. 19(*e*) and 19(*f*) being straight as opposed to hook-shaped. The short hollow stub 13 of FIGS. 19(*b*), 19(*c*), 19(*e*) and 19(*f*) is made of foam or other dielectric materials. Wire 15 in FIGS. 19(*b*)–19(*c*) is optionally soldered to probe 31 at point 119 while wire 15 in FIG. 19(*f*) is also used to form probe 31 because probe 31 extends centrally downward into the waveguide through the bottom of hollow stub 13. The wire 15 in FIGS. 19(*c*), 19(*e*), and 19(*f*) may extend upward from stub 13 as in FIG. 19(*b*) to improve reception characteristics. Probes 31 of elements 1 extend into the center of the waveguide combiner.

FIGS. 20(*a*)–20(*b*) are top and side elevational cross-sectional views respectively of an alternative embodiment of either lens 53 or 55 in the form of a waveguide. This approach for the lens uses a pair of parallel plates, namely, solid top plate 130 and machined bottom plate 132. Bottom plate 132 is designed to support a TEM excitation from probes 133 inserted into the channels 135 of bottom plate 132. Channels 135 on the element/subarray side of plate 132 incorporate the required delay line for setting up the desired beam spacing. Channels 137 defined on the beam side of plate 132 feed the output block 69. Machined hollow area 139 of bottom plate 132 includes channels 135 and 137 as well as the central area more clearly shown cross-sectionally in FIG. 20(*b*). According to certain embodiments, there may be twelve ports 135 and nine beam ports 137. Plates 132 and 130 may be metal, or alternatively made of plastic and coated with a conductive layer.

An alternative to the FIGS. 20(*a*)–20(*b*) embodiment of lens 53, 55 is to mold a known dielectric material such as polystyrene foam, microwave laminate, or plastic into the form of area 139 (including ports 135 and 137) and thereafter apply a conductive material to the outside thereof by way of plating, painting, etc. Probes 133 would then be inserted to the proper depth into the dielectric material (but not touching the conductive coating). With respect to this embodiment as well as the FIGS. 20(*a*)–20(*b*) embodiment of the lens, a horn or flare area 141 is provided adjacent the interior sides of both the beam and subarray ports for the purpose of bringing energy onto and off of the lens. This flare or horn design 141, present on the interior side of all ports, is an improvement over the prior art with respect to packaging and functionality.

The lenses of FIGS. 20(*a*)–20(*b*) need not be flat, but instead may be bent in accordance with the intended application (e.g. cosmetic reasons).

Once given the above disclosure, therefore, various other modifications, features or improvements will become apparent to the skilled artisan. Such other features, modifications, and improvements are thus considered a part of this invention, the scope of which is to be determined by the following claims. For example, the above-discussed multiple beam antenna system can receive singularly or simultaneously any polarity (circular or linear) from a single or multiple number of satellites, from a single or multiple number of beams, knowing that co-located satellites utilize frequency and/or polarization diversity.

We claim:

1. A multi-beam antenna system for receiving signals of different polarity, the system comprising:

a receiving device for receiving both linearly polarized signals and circularly polarized signals at substantially the same frequency;

a first electromagnetic lens for receiving signals from the receiving device;

a second electromagnetic lens for receiving signals from the receiving device; and means for manipulating said first and second electromagnetic lenses so as to enable the system to receive and process circularly polarized signals and linearly polarized signals such that the circularly and linearly polarized signals are processed after going through said lenses.

2. A multi-beam antenna system for receiving signals that are orthogonal to one another, the system comprising:

a receiving device for receiving first and second signals that are orthogonal to one another, at substantially the same frequency;

a first electromagnetic lens for receiving signals from said receiving device and a second electromagnetic lens for receiving signals from said receiving device, such that said first lens receives a first type of signals from said receiving device and said second lens receives a second different type of signals from said receiving device, wherein the first and second types of signals are orthogonal to one another;

means for manipulating said first and second electromagnetic lenses and signals therefrom so as to enable the system to process at least one of: (i) right-handed circularly polarized signal; (ii) left-handed circularly polarized signals; and (iii) linearly polarized signals, so that at least linearly polarized signals are processed following said orthogonal signals being output from said lenses.

3. The system of claim 2, wherein said means for manipulating manipulates said first and second electromagnetic lenses so as to enable the system to receive each of right-handed circularly polarized signals, left-handed circularly polarized signals, and linearly polarized signals.

4. The system of claim 2, further including means for receiving said signals that are orthogonal to one another at substantially the same time.

* * * * *